US012698944B1

(12) United States Patent
Lazor et al.

(10) Patent No.: US 12,698,944 B1
(45) Date of Patent: Aug. 4, 2026

(54) THERMOACOUSTIC HEAT EXCHANGER SUPPRESSOR

(71) Applicant: Quantum Additive, LLC, Cleveland, OH (US)

(72) Inventors: Ernest R. Lazor, Cleveland, OH (US); Todd Allen, Cleveland, OH (US); Philip M. Henry, Cleveland, OH (US); Scott Kraemer, Cleveland, OH (US)

(73) Assignee: Quantum Additive, LLC, Cleveland, OH (US)

( * ) Notice: Subject to any disclaimer, the term of this patent is extended or adjusted under 35 U.S.C. 154(b) by 0 days.

(21) Appl. No.: 19/244,061

(22) Filed: Jun. 20, 2025

(51) Int. Cl.
*F41A 21/30* (2006.01)

(52) U.S. Cl.
CPC ..... *F41A 21/30* (2013.01)

(58) Field of Classification Search
CPC ..... F41A 21/30–38
USPC ..... 89/14.1–14.4; 181/223
See application file for complete search history.

(56) References Cited

U.S. PATENT DOCUMENTS 6,298,764 B1 * 10/2001 Sherman ..... F41A 21/36 89/14.2
8,196,701 B1 * 6/2012 Oliver ..... F41A 21/30 89/14.4
11,428,491 B2 * 8/2022 Nagy-Zambo ..... F41A 21/30
2015/0285575 A1 * 10/2015 Sclafani ..... F41A 21/30 29/402.08
2017/0003094 A1 * 1/2017 Person ..... F41A 21/30
2018/0292160 A1 * 10/2018 Petersen ..... F41A 21/44
2019/0277591 A1 * 9/2019 Schwartzkopf ..... F41A 21/30
2020/0292268 A1 * 9/2020 Lo ..... F41A 21/30
2021/0071978 A1 * 3/2021 Washburn, III ..... F41A 21/30
2021/0333061 A1 * 10/2021 Muceus ..... F41A 21/30
2025/0137746 A1 * 5/2025 Chow ..... F41A 21/30

FOREIGN PATENT DOCUMENTS

DE 102018221095 A1 * 6/2020 ..... B33Y 80/00
WO 2008125092 A1 10/2008

* cited by examiner

*Primary Examiner* — Benjamin S Gomberg
(74) *Attorney, Agent, or Firm* — Renner, Otto, Boisselle & Sklar, LLP

(57) ABSTRACT

A silencer core for suppressing and dissipating at least one of a sound, a flame, or a quantity of heat of a projectile fired from a firearm includes a thermoacoustic organic structure (TOS) extending along a central axis from a first end to a second end. The TOS defines a central bore extending along the central axis from the first end to the second end. The central bore enabling the projectile to pass through the TOS when fired from the firearm. The TOS also defines a network of interconnected passages or a mesh configured to move at least one of combustion gases, heat, or sound from the central bore to an outside diameter of the TOS. The TOS has a density between 1.5 g/cm$^3$ to 4 g/cm$^3$.

20 Claims, 20 Drawing Sheets

THERMOACOUSTIC HEAT EXCHANGER SUPPRESSOR

TECHNICAL FIELD

The present disclosure relates to a non-monolithic suppressor with multiple distinct, separate parts or elements that may be used with a firearm. More specifically, the present disclosure relates to a firearm suppressor having a thermoacoustic organic structure core produced by additive manufacturing of materials having relatively low density and having a relatively high coefficient of thermal effusivity. Firing a projectile from a firearm initiates the thermoacoustic effect wherein interactions between temperature, density, and pressure variations create acoustic waves. In the effect, heat energy is converted to sound energy, and vice versa. The effect is driven by convection and oscillations in pressure resulting in periodic airflow through a tube or stack created by a thermoacoustic organic structure moving from hot regions to cold regions of the structure to dissipate both heat and sound.

BACKGROUND

Firearm silencers or suppressors such as, for example, those used by soldiers in armed combat, can, at times, present challenges regarding weight, heat dissipation, and cleaning efficacy. In some examples, a silencer is attached to a muzzle of a firearm and the firearm is used in combat or a combat training exercise. The silencer can add an amount of weight to the firearm and/or to a soldier's total pack weight. The additional weight in either the firearm or the materials that a soldier must carry is often undesired. In some examples, the silencer adds additional weight at a muzzle end of the firearm, providing an undesired change to the front-to-rear weight balance of the firearm. This balance alteration can result in degraded marksmanship, particularly after a number of consecutive shots fired within a relatively short time. Many silencers or suppressors are also unable to properly distribute an amount of heat generated by firing a ballistic projectile, resulting in an exterior surface of the silencer being too hot to comfortably handle. Additionally, some silencers or suppressors have interior surfaces that are difficult and/or time-consuming to clean which can lead to an undesired build-up of carbon fouling and other materials.

SUMMARY

Many known silencers or suppressors are not designed and manufactured to enable the use of materials having relatively low density. Additionally, many known silencers or suppressors do not use these materials that also exhibit relatively high coefficients of thermal effusivity. Use of these materials, in some examples, leads to relatively heavy and, particularly after continuous firing of the firearm, exterior surfaces of the silencer that are undesirably hot to the touch. Moreover, many silencers feature a one-piece construction. As a result, cleaning the silencer can be time consuming and require disassembly of a majority of the silencer, thus limiting the potential to clean and re-use the silencer. In some instances, users (e.g., soldiers) may simply discard the silencer and replace the silencer with a new silencer.

An aspect according to the present disclosure provides a silencer core using a relatively low-density material to reduce the mass or weight of the silencer core. An added benefit of the low-density material is reduced heat absorption and an increased coefficient of thermal effusivity. The silencer core is formed by a thermoacoustic organic structure (TOS) having a central bore and a network of interconnected passages to effectively dissipate the heat created by firing the projectile while also suppressing and dissipating an amount of sound and other effects of firing the projectile.

Generally, the silencer core suppresses and dissipates the effects of firing a projectile from a firearm. The silencer core includes a TOS extending along a central axis from a first end to a second end. The TOS defines a central bore extending along the central axis from the first end to the second end. The central bore enables the projectile to pass through the TOS when fired from the firearm. The TOS also defines a network of interconnected passages configured to move at least one of combustion gases, heat, or sound from the central bore to an outside diameter of the TOS. The TOS has a density between 1.5 g/cm$^3$ to 4 g/cm$^3$.

An aspect according to the present disclosure provides a silencer assembly including a cylindrical TOS and a shell. The shell is configured to surround the cylindrical TOS to facilitate heat transfer between the cylindrical TOS and the shell. The cylindrical TOS is removable from the shell for cleaning, replacement, or other functions.

More particularly, according to another aspect of the present disclosure, the silencer apparatus includes a cylindrical TOS extending along a central axis from a first end to a second end. The cylindrical TOS defines a central bore extending along the central axis from the first end to the second end. The cylindrical TOS also defines a network of passages configured to move at least one of combustion gases, heat, or sound from the central bore to an outside diameter of the cylindrical TOS, wherein the solid material portion of the cylindrical TOS has a density between 1.5 g/cm$^3$ to 4 g/cm$^3$. The silencer apparatus also includes a shell extending from a barrel end to a muzzle end. The shell is configured to at least partially surround and interact with the cylindrical TOS to facilitate heat transfer between the cylindrical TOS and the shell. The cylindrical TOS is selectively removable from the shell.

Some embodiments of the present disclosure include shells that further include a first cylindrical member that interacts with the cylindrical TOS. A second cylindrical member is concentrically spaced a distance from the first cylindrical member and is attached to the first cylindrical member through a plurality of spokes. The first cylindrical member and the second cylindrical member together define an open space between the first cylindrical member and the second cylindrical member. Some embodiments have a shell that includes an axial baffle extending away from the first cylindrical member and toward the second cylindrical member. The axial baffle is configured to provide an axial channel in fluid communication with a space outside the barrel end and a space outside the muzzle end of the shell.

An aspect according to the present disclosure provides a silencer apparatus including a cylindrical TOS having a central bore and a network of passages. The cylindrical TOS is relatively light weight and is formed by an additive manufacturing process. A shell for the silencer apparatus shell is provided to dissipate heat from the firing of a projectile from the firearm to limit a temperature of an exterior surface of the shell.

More particularly, according to another aspect of the present disclosure, a silencer apparatus for suppressing at least one of a sound, a flame, or a quantity of heat of a projectile fired from a firearm includes a cylindrical TOS extending along a central axis from a first end to a second end. The cylindrical TOS defines a central bore extending along the central axis from the first end to the second end.

The cylindrical TOS also defines a network of passages configured to move combustion gases from the central bore to an outside diameter of the cylindrical TOS. The cylindrical TOS has a density between 1.5 g/cm$^3$ to 4 g/cm$^3$ and is formed by an additive manufacturing process. The silencer apparatus includes a shell extending from a barrel end to a muzzle end. The shell is configured to at least partially surround and interact with the cylindrical TOS to facilitate heat transfer between the cylindrical TOS and the shell. The shell includes a first cylindrical member configured to interact with the cylindrical TOS and a second cylindrical member spaced a distance from the first cylindrical member. The second cylindrical member is concentric to the first cylindrical member and is attached to the first cylindrical member through a plurality of spokes extending from the first cylindrical member to the second cylindrical member. The first cylindrical member and the second cylindrical member together define an open space between the first cylindrical member and the second cylindrical member. The cylindrical TOS is selectively removable from the shell.

The following description and the annexed drawings set forth certain illustrative embodiments of the disclosure. These embodiments are indicative, however, of but a few of the various ways in which the principles of the disclosure may be employed. Other objects, advantages and novel features according to aspects of the disclosure will become apparent from the following detailed description when considered in conjunction with the drawings.

BRIEF DESCRIPTION OF THE DRAWINGS

The annexed drawings, which are not necessarily to scale, show various aspects of the silencer apparatus and its use.

DETAILED DESCRIPTION

Figure 1:
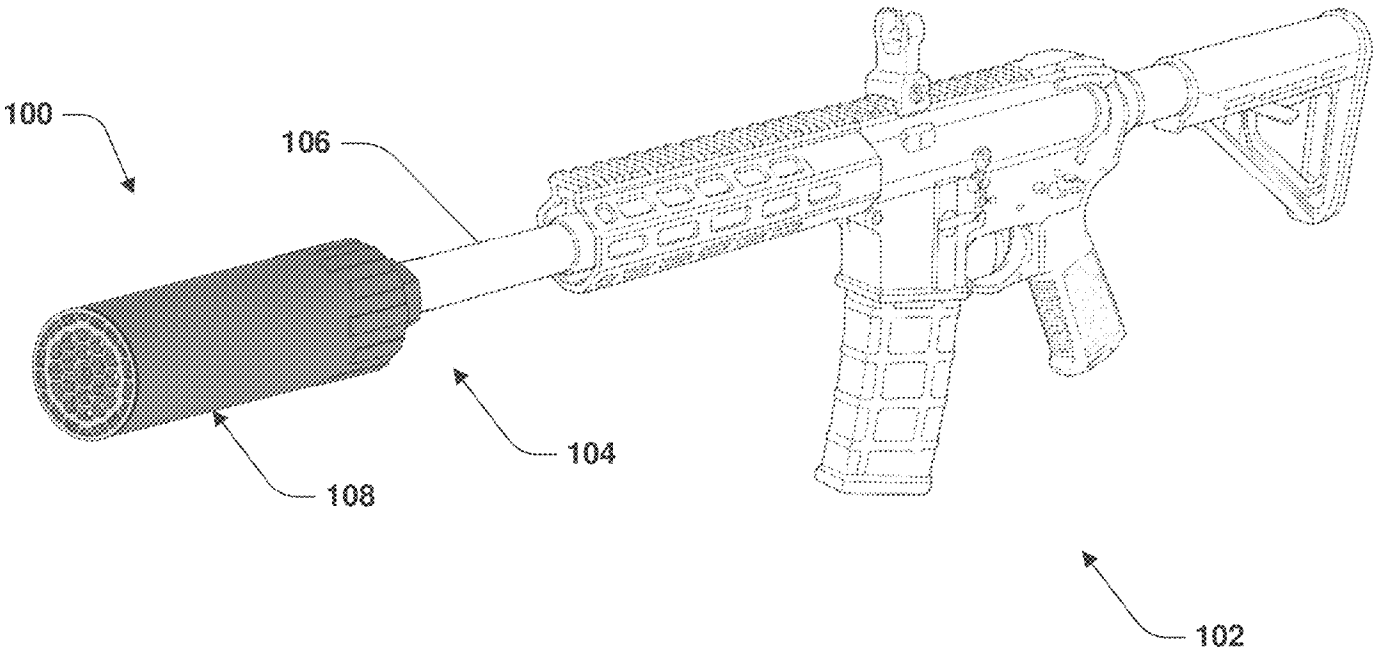
FIG. 1 is a perspective view of a firearm and an exemplary silencer apparatus attached to a muzzle of the firearm.

While the described apparatus and methods can take many different forms, for the purpose of promoting an understanding of the principles of the disclosure, reference will now be made to the embodiments illustrated in the drawings and specific language will be used to describe the same. It will nevertheless be understood that no limitation of the scope of the disclosure is thereby intended.

Generally, the present disclosure is directed to a firearm silencer or suppressor that provides a relatively low-weight device having a relatively high coefficient of thermal effusivity. These silencers include a core constructed of a metal or ceramic material produced by an additive manufacturing process. In some examples, the core is configured with passages having axial and radial components. In some examples, the core is configured with a mesh TOS of material formed by additive manufacturing. The mesh can include a percentage of solid material optimized to suppress sound or flash effects from firing a ballistic projectile. In some examples, the mesh material TOS can vary in percentage of solid material along an axial direction of the silencer.

Regardless of whether the core is formed with passages or a mesh-type configuration, the core is configured to cooperate with a shell to suppress and dissipate heat generated from firing the ballistic projectile. The core is removable from the shell to ease a core cleaning process to remove undesired accumulation of material within the core. In some examples, the silencer/suppressor suppresses and dissipates heat, sound, and flash for a rifle, although this is merely one example of use for the silencer, and other silencer implementations on various other types of firearms are also contemplated. This disclosure will use terms such as silencer, silencer apparatus, and suppressor as being synonymous.

Referring initially to FIG. 1, a silencer apparatus 100, or silencer, is shown attached to a firearm 102 at a muzzle end 104 of a barrel 106 of the firearm 102. The silencer can be used to suppress and dissipate at least one of a sound, a flame (e.g., muzzle flash), or a quantity of heat generated by firing a ballistic projectile (e.g., a bullet) from the firearm 102. It can be beneficial in some circumstances, such as during combat, to suppress and dissipate the sound, flash, and heat to help avoid location detection, promote stealth military activities, and reduce the chances of an exterior surface 108 of the silencer 100 from becoming overheated. These benefits can be more important when the firearm 102 is operated in semi-automatic or automatic fire modes such that relatively large quantities of bullets can be fired within a relatively short amount of time. For example, semi-automatic or automatic fire can rapidly increase a temperature of the exterior surface 108 of the silencer, Referring to FIG. 2, the silencer 100 includes a shell 200 that extends from a barrel end 202 to a muzzle end 204. The barrel end 202 can be selectively attached to the barrel 106 of the firearm as shown in FIG. 1 by any suitable structure or method. In some examples, the silencer 100 is generally cylindrical and is centered about a central axis 206.

Figure 3:
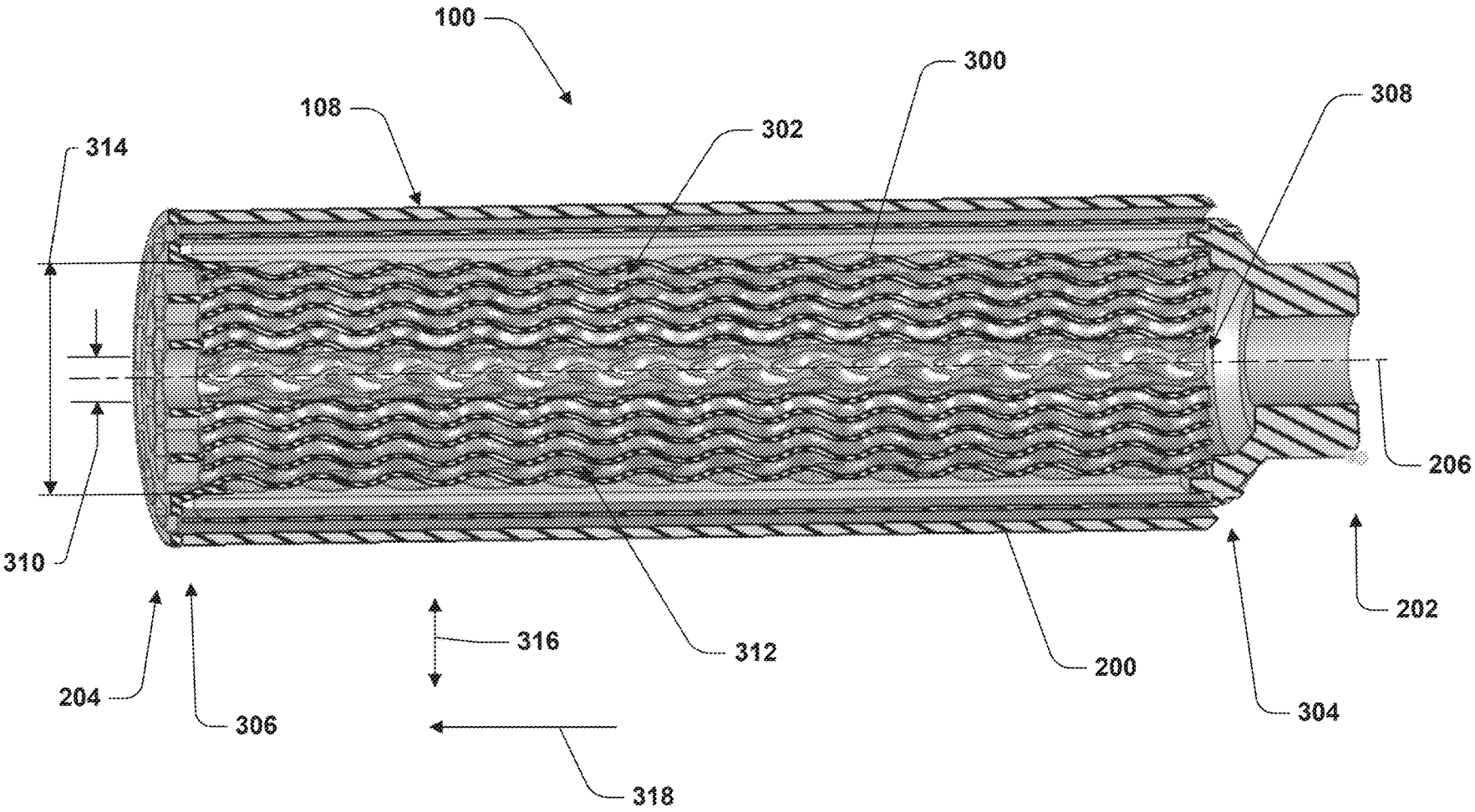
FIG. 3 is an axial cross-section view of the silencer of FIG. 2 taken along line 3-3.
Figure 4:
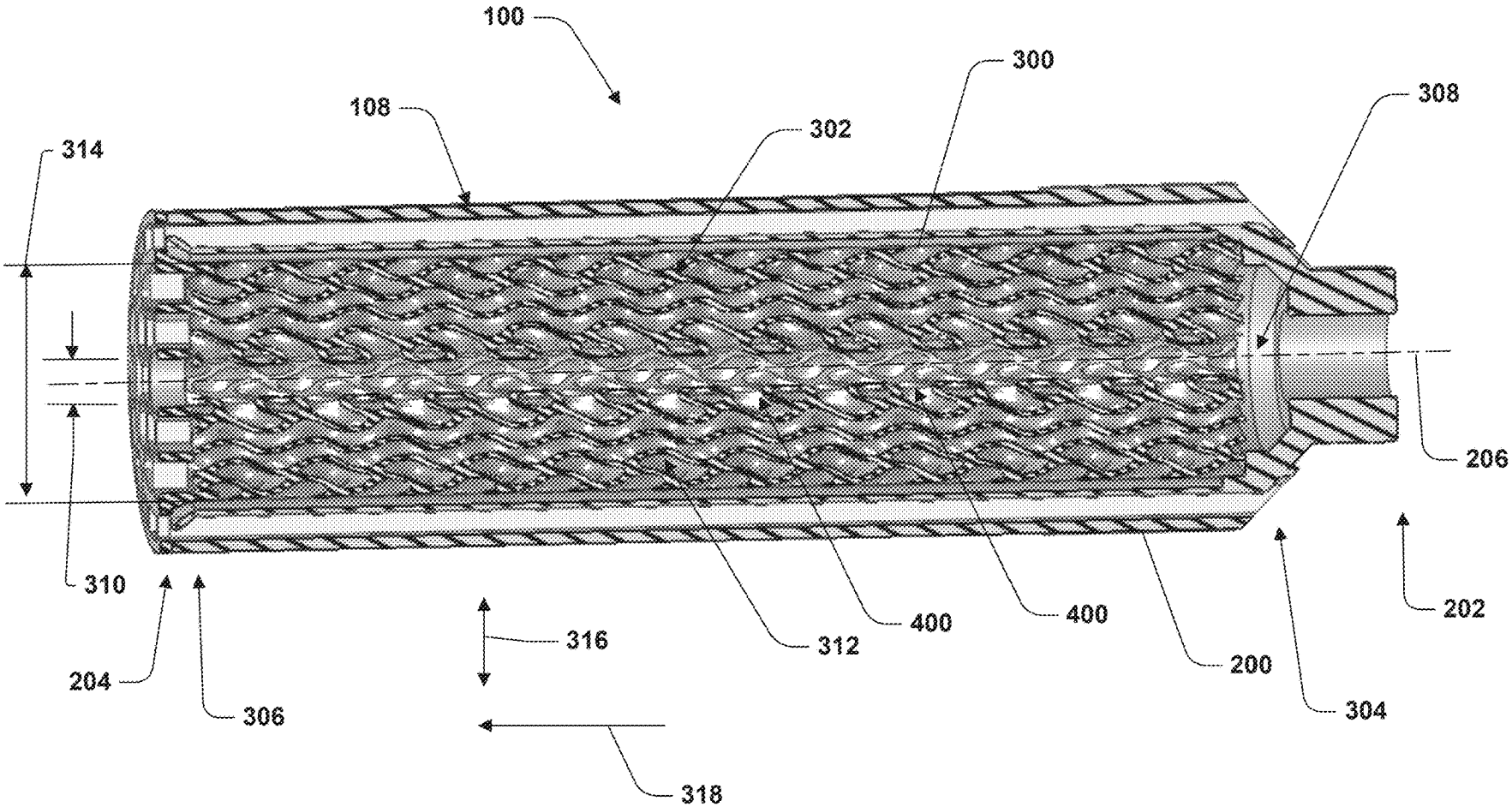
FIG. 4 is an axial cross-section view of the silencer of FIG. 2 taken along line 4-4.
Figure 5:
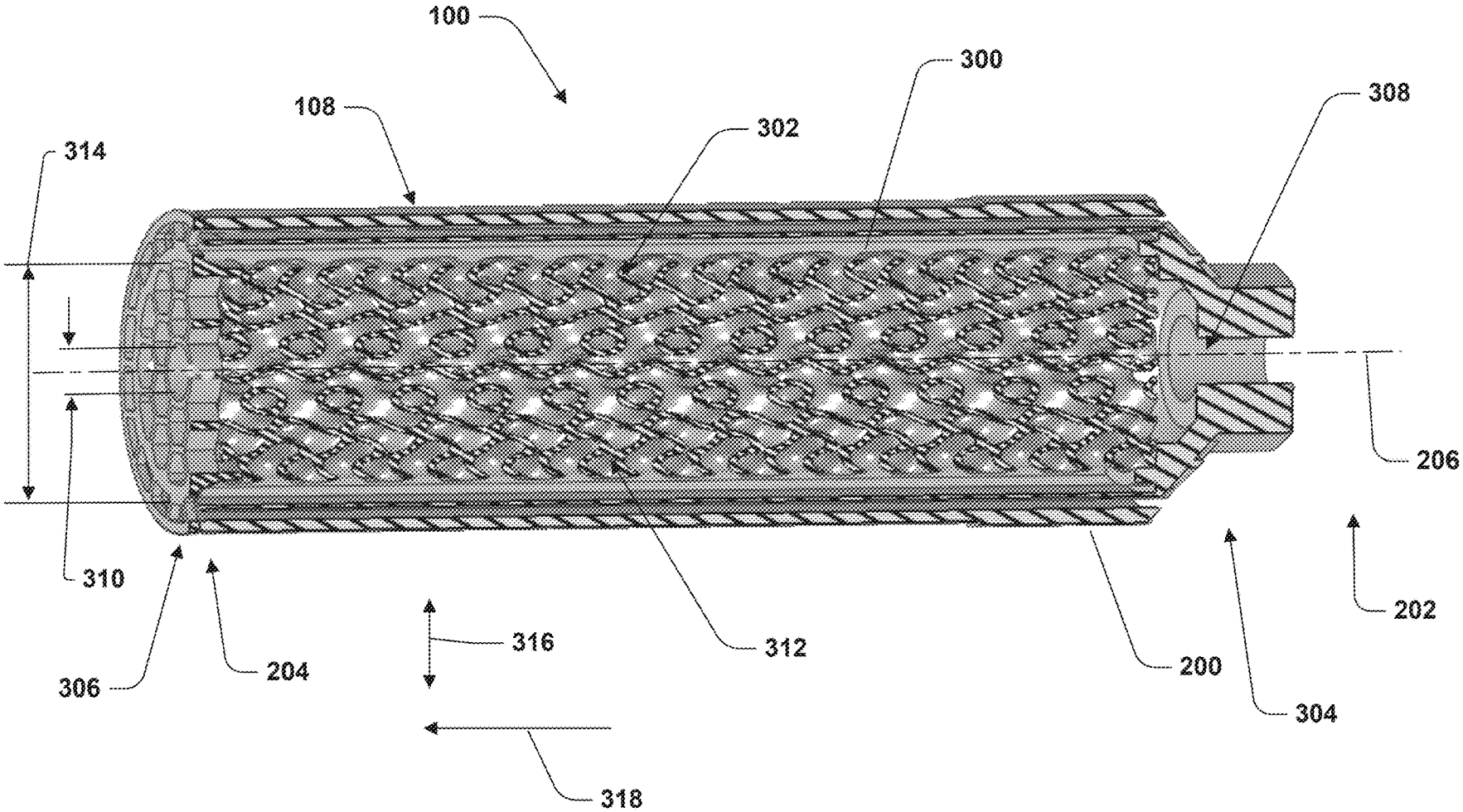
FIG. 5 is an axial cross-section view of the silencer of FIG. 2 taken along line 5-5.
Figure 7:
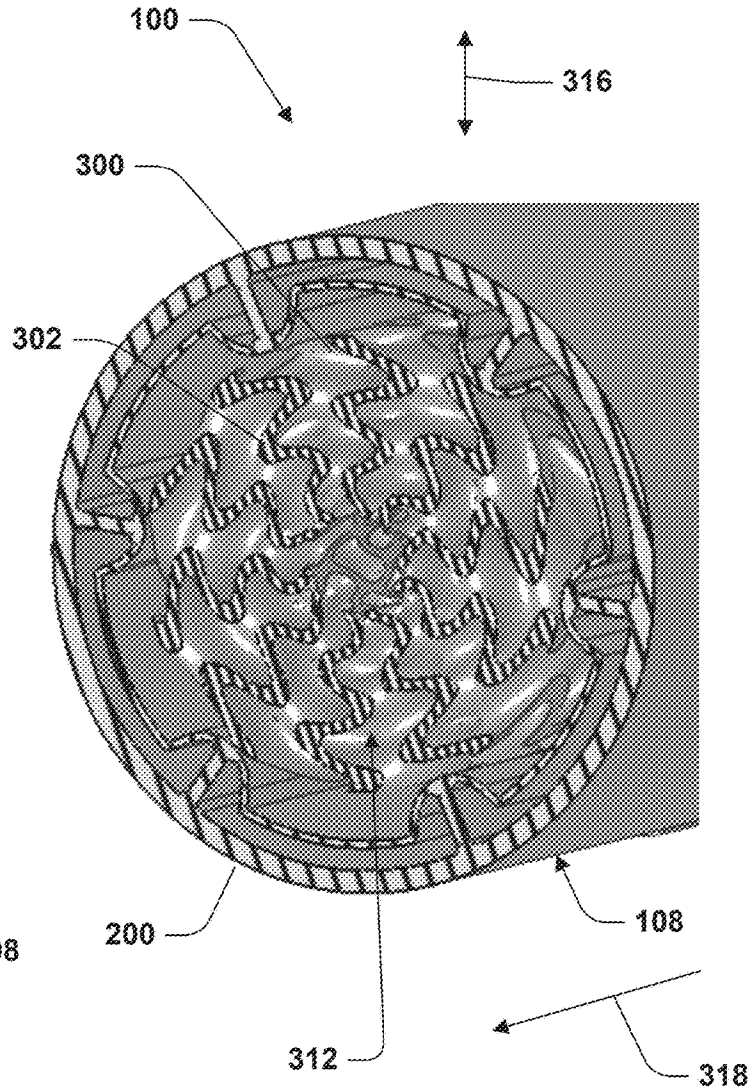
FIG. 7 is a radial cross-section view of the silencer of FIG. 2 taken along line 7-7.
Figure 6:
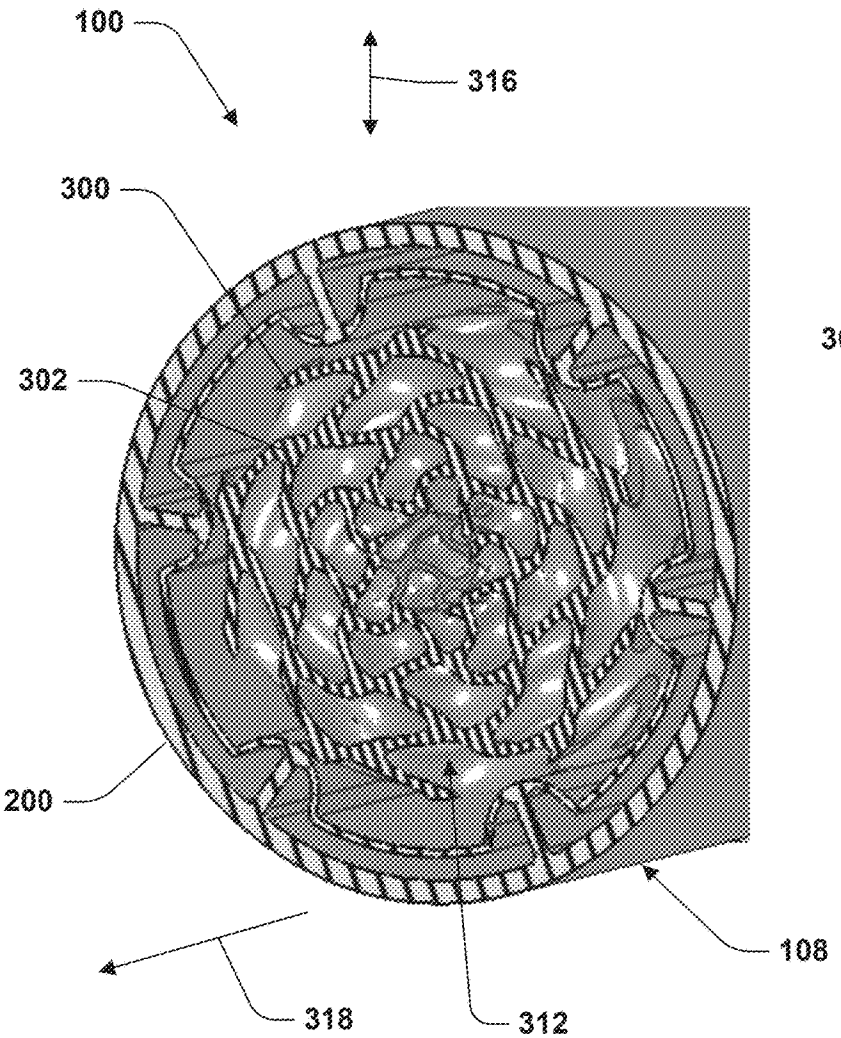
FIG. 6 is a radial cross-section view of the silencer of FIG. 2 taken along line 6-6.
Figure 9:
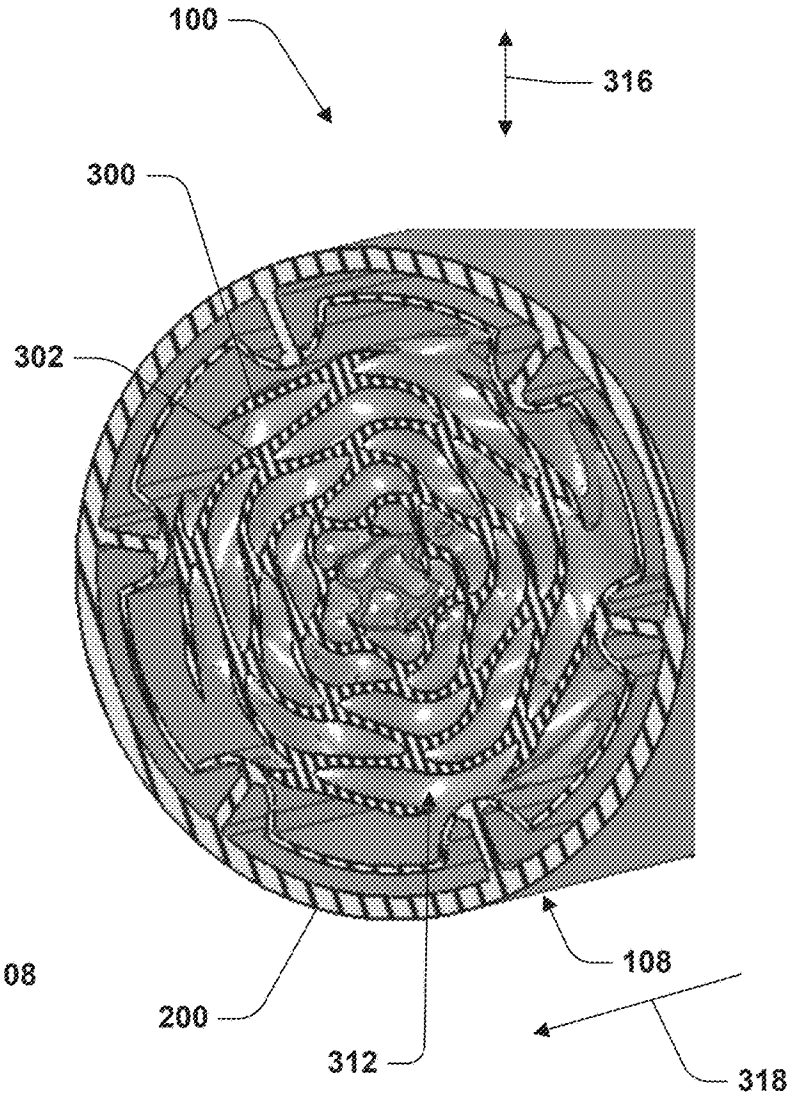
FIG. 9 is a radial cross-section view of the silencer of FIG. 2 taken along line 9-9.
Figure 8:
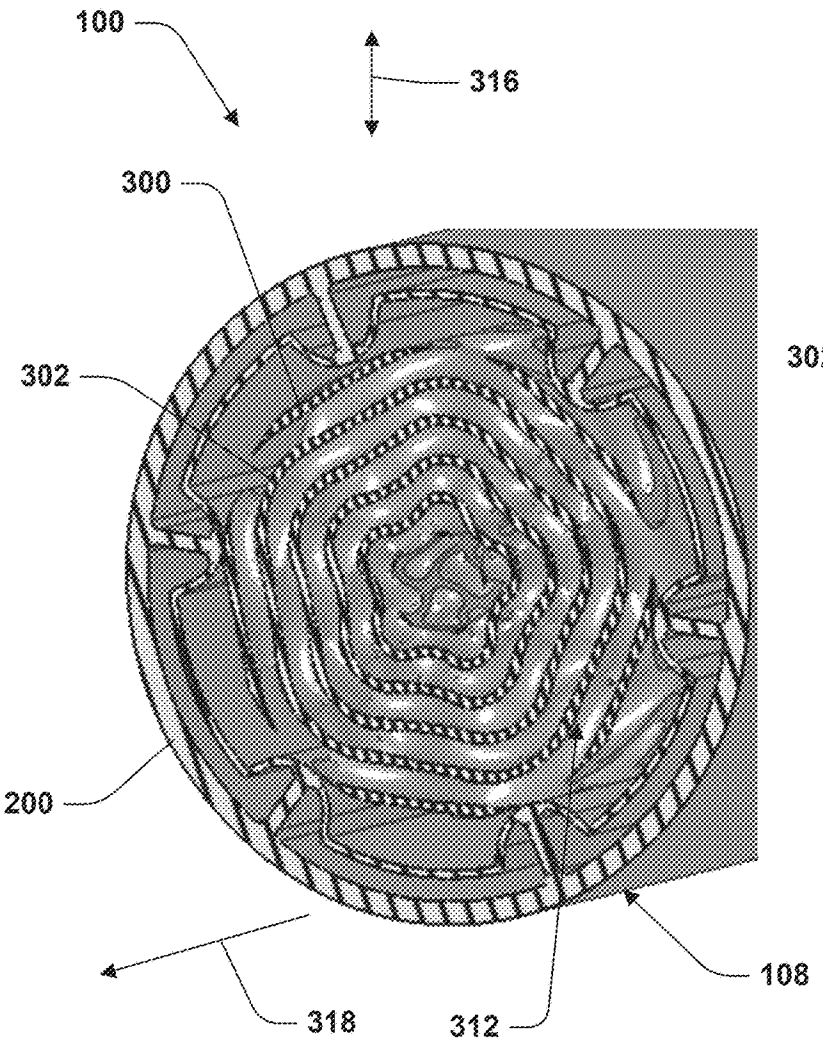
FIG. 8 is a radial cross-section view of the silencer of FIG. 2 taken along line 8-8.

Referring to FIGS. 3-5, cross-sections of the silencer 100 show additional detail of a silencer core 300 located within the shell 200. The silencer core 300, or core 300, includes a TOS 302 that extends from a barrel end 304 to a muzzle end 306. The barrel end 304 of the core 300 is located proximate the barrel end 202 of the shell 200. Similarly, the muzzle end 306 of the core 300 is located proximate the muzzle end 204 of the shell 200.

The TOS 302 defines a central bore 308 extending along the central axis 206 from the barrel end 304 to the muzzle end 306. The central bore 308 enables the projectile (e.g., the bullet) to pass through the TOS 302 when fired from the firearm 102. An inside diameter 310 of the central bore 308 can be engineered and manufactured to a relatively tight tolerance in relation to a caliber of the projectile. The inside diameter 310 of the central bore 308 is spaced a distance from the path of the projectile such that the projectile does not touch the TOS 302 when passing through the core 300.

The TOS 302 also defines a network of interconnected passages 312 or channels configured to move at least one of the combustion gases, the quantity of heat, or the sound from the central bore 308 to or toward an outside diameter 314 of the TOS 302. This direction of movement of gases, heat, and sound can be described as a radially outward direction and is represented by the direction of arrow 316. Similarly, the interconnected passages 312 move the gases, the heat, and the sound in the axial direction from the barrel end 304 to the muzzle end 306 as represented by arrow 318.

In some examples, the TOS 302 defines the network of interconnected passages 312 for cooling and venting the gases produced when the firearm 102 is fired. Additive manufacturing allows the TOS 302 to be constructed with a relatively complex geometry that would not lend itself to other, more traditional methods of manufacturing such as machining, casting, assembling multiple stamped parts, etc. Additive manufacturing can produce the TOS 302 of the silencer core 300 such that the TOS defines the network of interconnected passages 312 through which the gases and heat produced by the firearm 102 can flow. The flow patterns through the interconnected passages 312 can take almost infinite forms from a relatively uniform pattern to a chaotic, unpredictable flow pattern. The patterns can be affected by numerous factors such as elapsed time after firing the firearm 102, temperature gradients in the radial direction 316 and the axial direction 318, etc. Regardless of the flow pattern(s), the TOS 302 and the interconnected passages 312 are configured to improve suppression and dissipation of heat in addition to sound and muzzle flash.

Referring to FIG. 3, the vertical cross-section through the central axis 206 shows some portions of interconnected passages 312 that are oriented primarily in the axial direction 318. In some examples, as shown, each of these passages are curvilinear and provide a tortuous path for gases, sounds, and heat as they move toward the muzzle end 306.

Referring to FIG. 4, the vertical cross-section is moved slightly toward the viewer compared to the cross-section of FIG. 3, and we see the introduction of the interconnected passages 312 enabling fluid communication between the central bore 308 and the next outer portions of the interconnected passages 312, such as at locations 400.

Referring to FIG. 5, the vertical cross-section is moved slightly toward the viewer once again as compared to the cross-section of FIG. 4. Here, more portions of the interconnected passages 312 provide fluid communication leading in the radial direction 316.

Referring again to all of FIGS. 3-5, the solid portions of the TOS 302 have a density between 1.5 g/cm$^3$ to 4 g/cm$^3$. Materials possessing this relatively low-density physical property can reduce the weight of the silencer apparatus 100 by 50% or more compared to many known silencers and suppressors made of more traditional materials such as Inconel, stainless steel, etc.

Additionally, the silencer core 300 material forming the TOS 302 material has a coefficient of thermal effusivity between 6,000 W·s$^{0.5}$/(m$^2$·K) and 100,000 W·s$^{0.5}$/(m$^2$·K). Thermal effusivity (r) is measured as the square root of the product of a material's thermal conductivity ($\lambda$) and its volumetric heat capacity ($pc_p$) or as the ratio of thermal conductivity to the square root of thermal diffusivity ($\alpha$) according to the following formula:

$$r = \frac{\lambda}{\sqrt{\alpha}} = \sqrt{\lambda \rho c_p}$$

Materials having a thermal effusivity between 6,000 W·s$^{0.5}$/(m$^2$·K) and 100,000 W·s$^{0.5}$/(m$^2$·K) help dissipate heat generated by the firing of the ballistic projectile. As discussed, the material can quickly absorb this heat and transfer the heat through the material for relatively fast heat dissipation in the radial direction 316 and the axial direction 318. Then, through the processes of radiation, convection, and conduction heat transfer, the TOS 302 can relatively quickly suppress and dissipate the heat to the environment while minimizing the heat transferred to the exterior surface 108 of the silencer 100.

The material used in the additive manufacturing process of the TOS 302 of the silencer core 300 can include any suitable material or a combination of materials having a density between 1.5 g/cm$^3$ to 4 g/cm$^3$ and a thermal effusivity between 6,000 W·s$^{0.5}$/(m$^2$·K) and 100,000 W·s$^{0.5}$/(m$^2$·K). In some examples, the material can be a metallic material including, but not limited to, scalmalloy, TiAl4822, TiAl3, zirconium beryllide, and Al68-Ti15-Zr12. In some examples, the material can be a ceramic-containing material such as silicon carbide, beryllium oxide, another ceramic compound or a Ceramic Matrix Composite (CMC). Persons having skill in the art understand the general process of additive manufacturing, and the process will not be further described here.

CMC materials, for the purposes of this disclosure can include hybrid materials combining ceramic materials with metallic materials, ceramic materials with plastic materials, or at least two different ceramic materials. In some examples, CMC materials are constructed of ceramic fibers held together by ceramic or metallic binders. This combination enables creation of CMC materials that are well-suited to withstand relatively high (and low) temperatures while also being relatively light-weight to promote easy use and transportation.

The TOS 302 of the silencer core 300 as shown in FIGS. 3-5 is one example of perhaps infinite patterns suitable for suppressing and diffusing heat and other quantities using the additive manufacturing process with materials having a density between 1.5 g/cm$^3$ to 4 g/cm$^3$ and a coefficient of thermal effusivity between 6,000 W·s$^{0.5}$/(m$^2$·K) and 100,000 W·s$^{0.5}$/(m$^2$·K). This particular example is not meant to be limiting. In some examples, an amount of open space within a cylindrical volume defined by the TOS 302 is between 15% and 45% of the total volume defined by the cylindrical volume.

As discussed previously, each radial portion of an individual passage of the network of interconnected passages 312 can be defined by a tortuous path from the central bore 308 to the outside diameter 314. Similarly, each axial portion of an individual passage of the network of interconnected passages 312 can be defined by a tortuous path from the barrel end 304 to the muzzle end 306 or any other termination point in between the barrel end 304 and the muzzle end 306.

Figure 2:
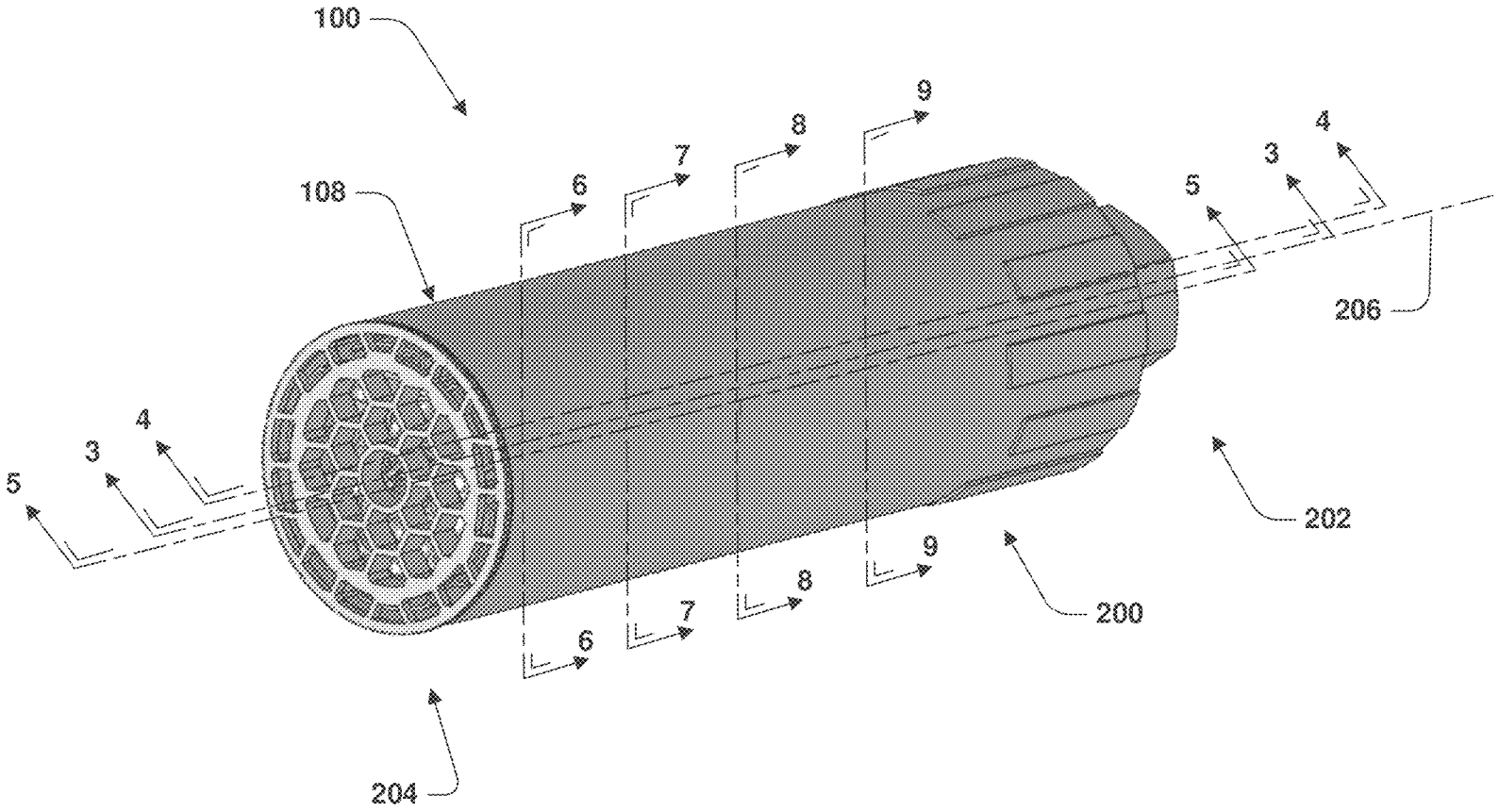
FIG. 2 is a perspective view of the silencer apparatus of FIG. 1.

Referring to FIGS. 6-9, radial cross-sections taken along the vertical planes shown in FIG. 2 are illustrated. Each of FIGS. 6-9 show additional surfaces of the cylindrical TOS 302 that includes a network of curvilinear passages (the interconnected passages 312) having components in the radial direction 316 and the axial direction 318 enabling movement of the at least one of combustion gases, heat, or sound from the central bore 308 of the cylindrical TOS 302 in the radial direction 316 and the axial direction 318.

Figure 10:
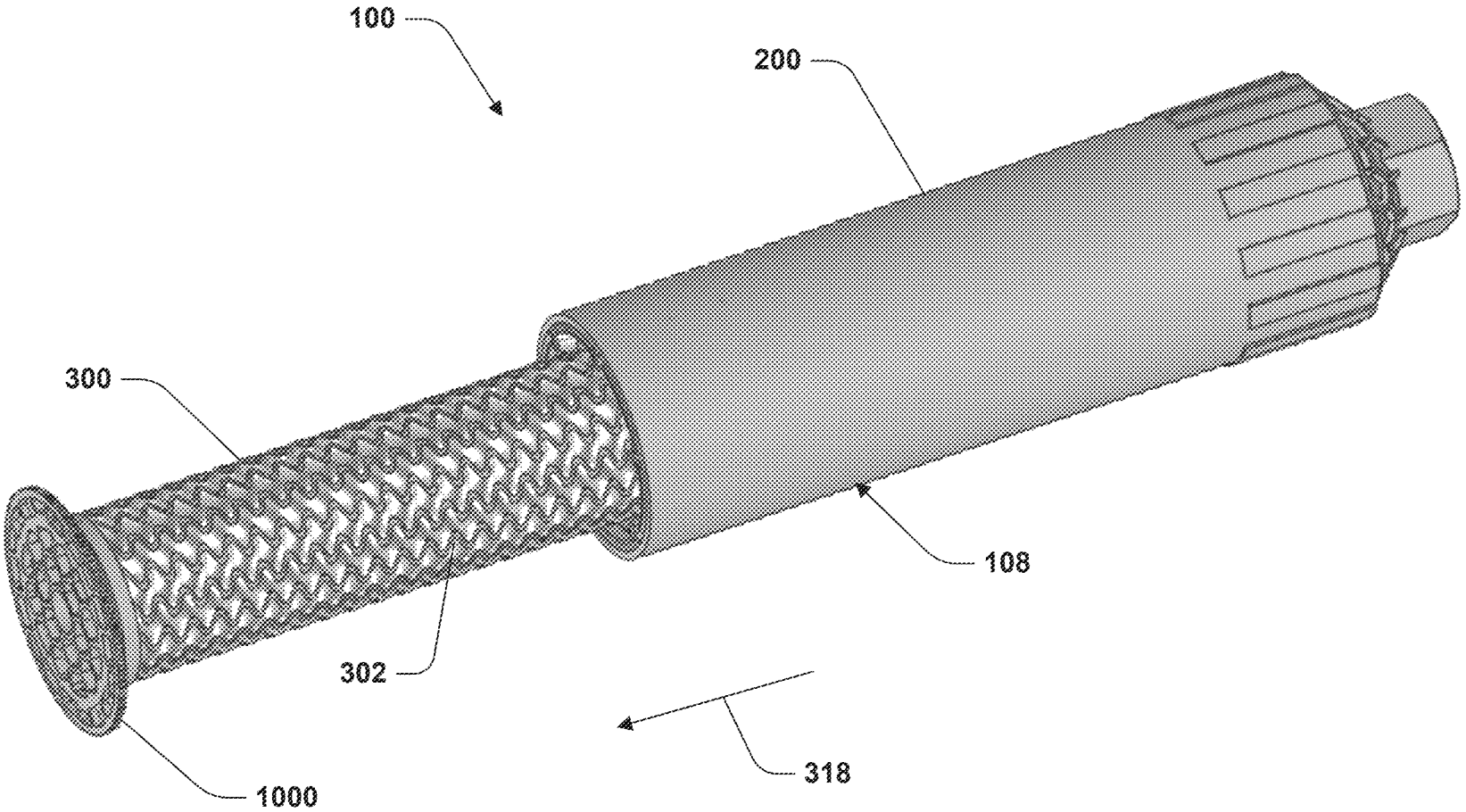
FIG. 10 is a partially exploded view of the silencer of FIG. 2.
Figure 11:
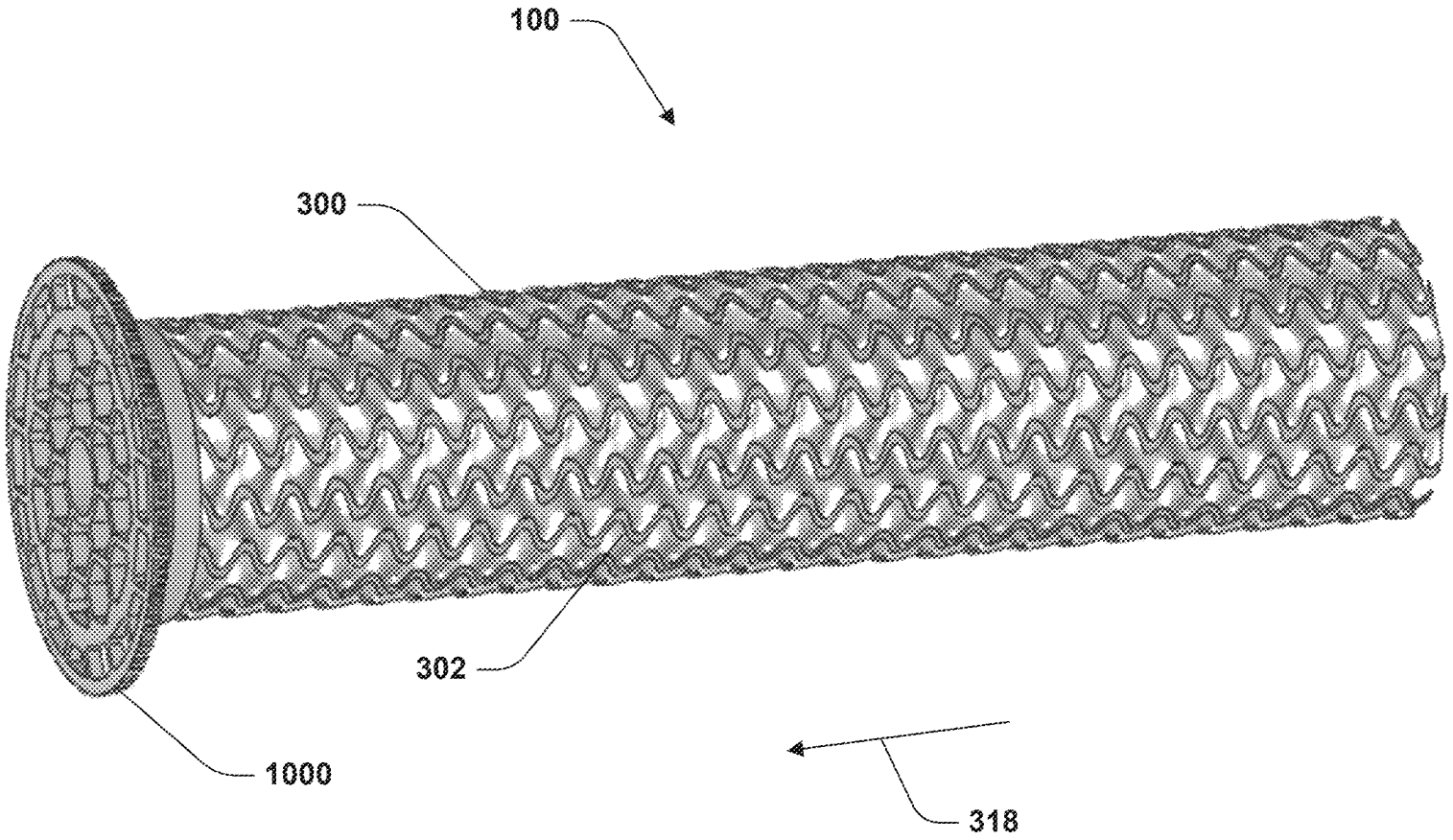
FIG. 11 is a perspective view of the core of the silencer.

Referring to FIGS. 10 and 11, The silencer apparatus 100 can include a cap 1000 configured to be attached to the muzzle end 306 of the TOS 302. In some examples, the cap 1000 is manufactured by additive manufacturing as an integral portion of the TOS 302. In other words, the cap 1000 and the TOS 302 can be a single, monolithic structure. In other examples, the cap 1000 can be separate from the TOS 302 and can be attached to either the TOS 302 or the shell 200 to help contain the core 300 and the TOS 302 within the shell 200.

As previously discussed, the shell extends from the barrel end 202 to the muzzle end 204. The shell 200 is engineered and manufactured to at least partially surround and interact with the cylindrical TOS 302 to facilitate heat transfer between the cylindrical TOS 302 and the shell 200, the cylindrical TOS 302 being selectively removable from the shell 200 for cleaning, replacement, etc. A cleaning operation for the TOS 302 can include an ultrasonic cleaning operation carried out to remove products generated from firing projectiles through the silencer 100. Some examples of these products include an undesired build-up of carbon fouling, copper residue, etc. Periodic cleaning of the TOS 302 can promote more efficient operation of the silencer 100.

FIG. 10 also demonstrates a modular nature of the silencer apparatus 100 in that the core 300 can be relatively easily removed from the shell 200 for the cleaning operation, replacement in the field, etc. The core 300 and the shell 200 can be mass produced to particular specifications and dimensions such that the core 300 can be easily replaced with another core as needed. In some examples, the replacement core is interchangeable with the core 300 such that an operation of the silencer apparatus 100 would not be appreciably different regardless of which core 300 is used.

Placement of a new core 300 into the shell 200 or replacement of the core 300 after cleaning can include any suitable securement structures and method to help ensure the core 300 remains reliably inserted within and/or attached to the shell 200.

Figure 12:
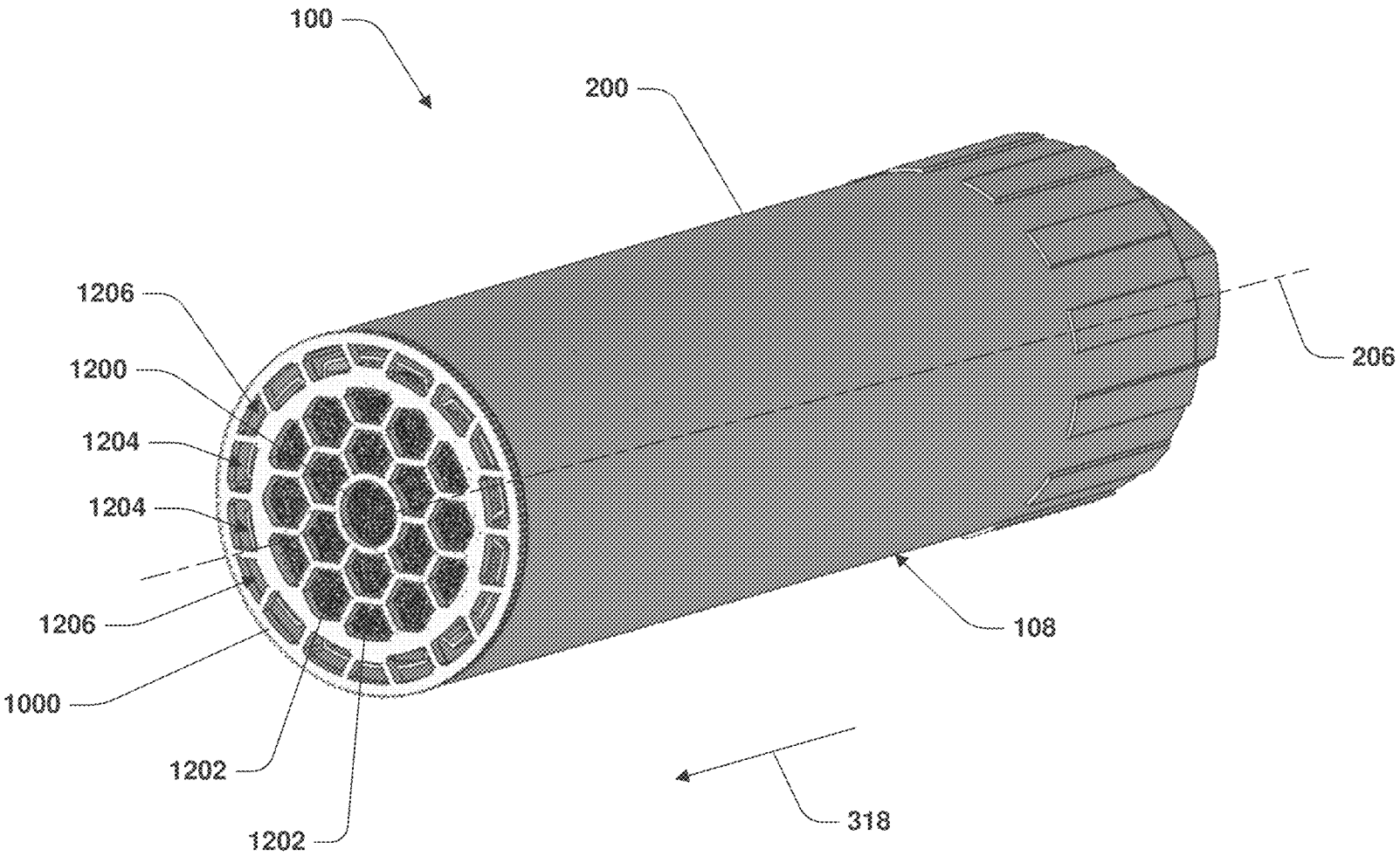
FIG. 12 is a perspective view of an exemplary silencer having a mesh configuration core.

Referring to FIG. 12, a second embodiment of the core 300 is illustrated. The cap 1000 defines several apertures passing through the entire thickness of the cap 1000. A central aperture 1200 is aligned with the central bore 308 enabling the ballistic projectile to pass out of the silencer 100 when the firearm 100 is fired. One or more apertures 1202 surround the central aperture 1200 enabling combustion products, suppressed sound, and dissipated heat to exit the silencer 100. The apertures 1202 can be aligned with one or more interconnected passages 312 of the core 300, but this is not required. Generally, a number of apertures 1202 constituting a larger open area providing fluid communication between the interconnected passages 312 and the environment surrounding the silencer 100.

Another set of circumference apertures 1204 can be arranged at the outside diameter of the cap 1000 enabling fluid communication with a defined open area of the shell 200 which will be described below. One or more baffle apertures 1206 can be provided at the outside diameter of the cap 1000 enabling fluid communication between a baffle of the shell and the environment surrounding the silencer 100. Any suitable number of baffle apertures 1206 can be provided, and in some examples, match the number of baffles within the shell 200.

Figure 13:
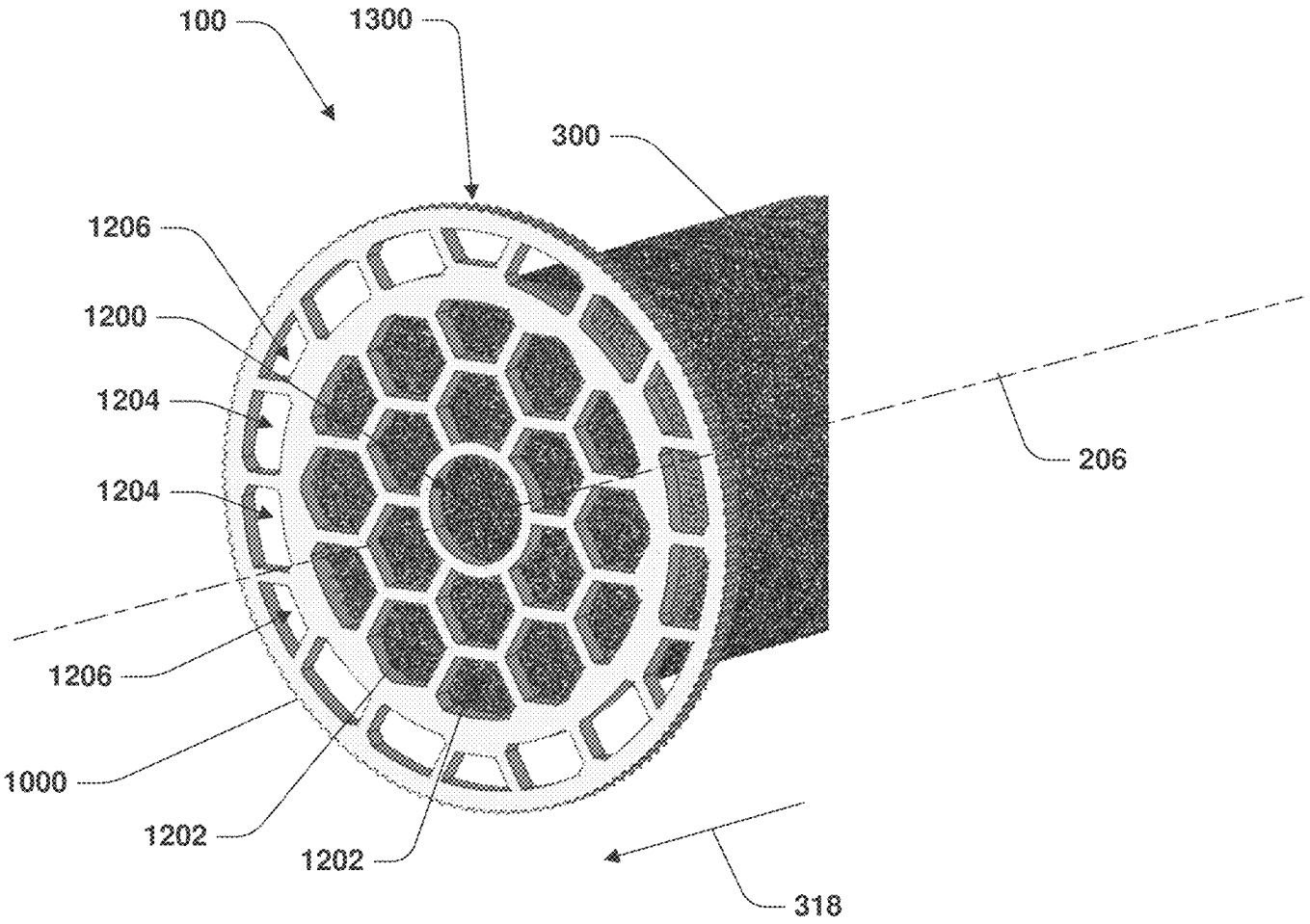
FIG. 13 is a perspective detail view of a cap and the core of the silencer of FIG. 12.

Referring to FIG. 13, the core 300 is illustrated outside of the shell 200. A circumferential surface 1300 of the cap 1000 can include a surface effects such as knurling, ridges, etc. to ease handling and/or operations of the core 300, particularly when the core 300 is removed from the shell 200.

Figure 14:
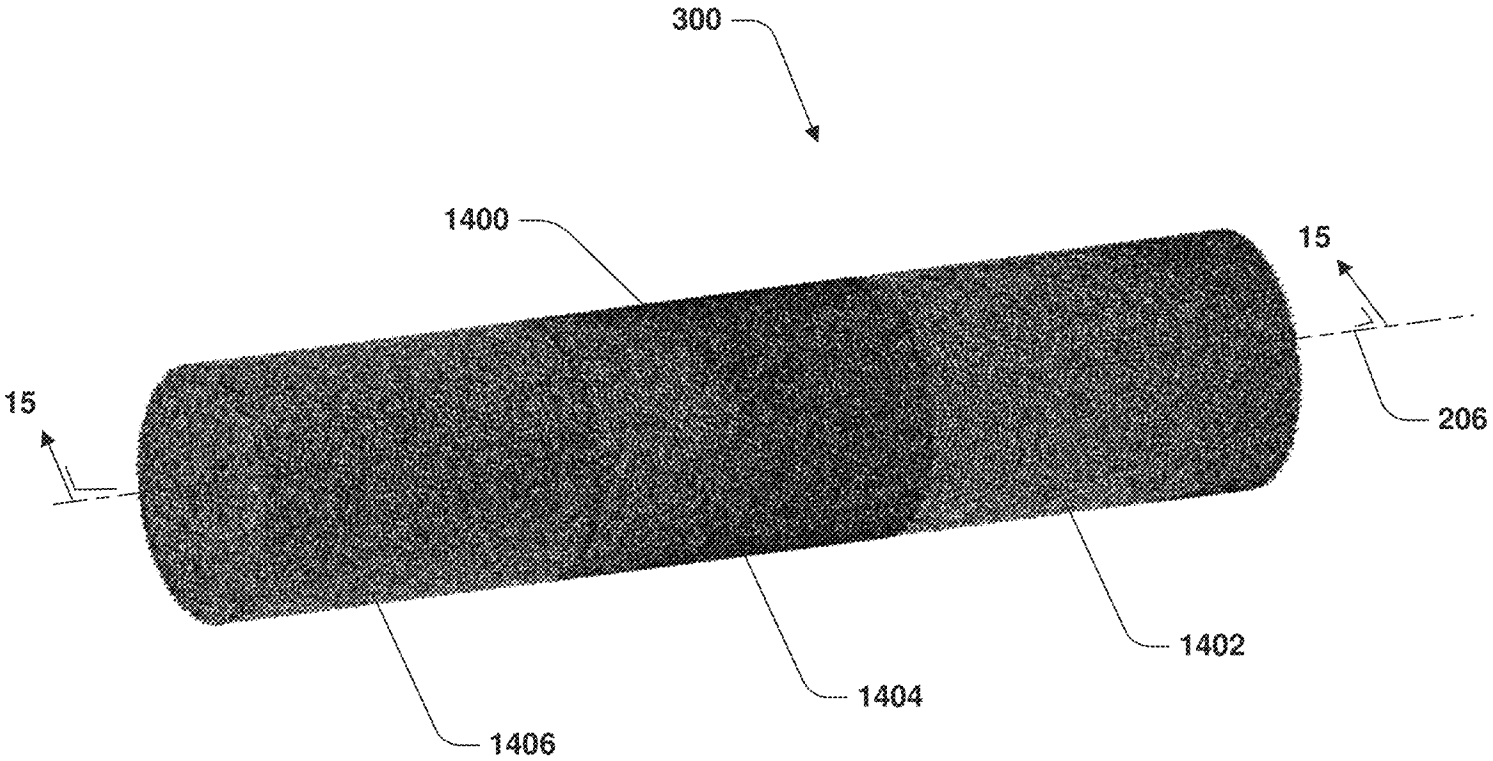
FIG. 14 is a perspective view of the core of FIG. 13 having a variable density along an axial direction, the core shown without the cap.
Figure 15:
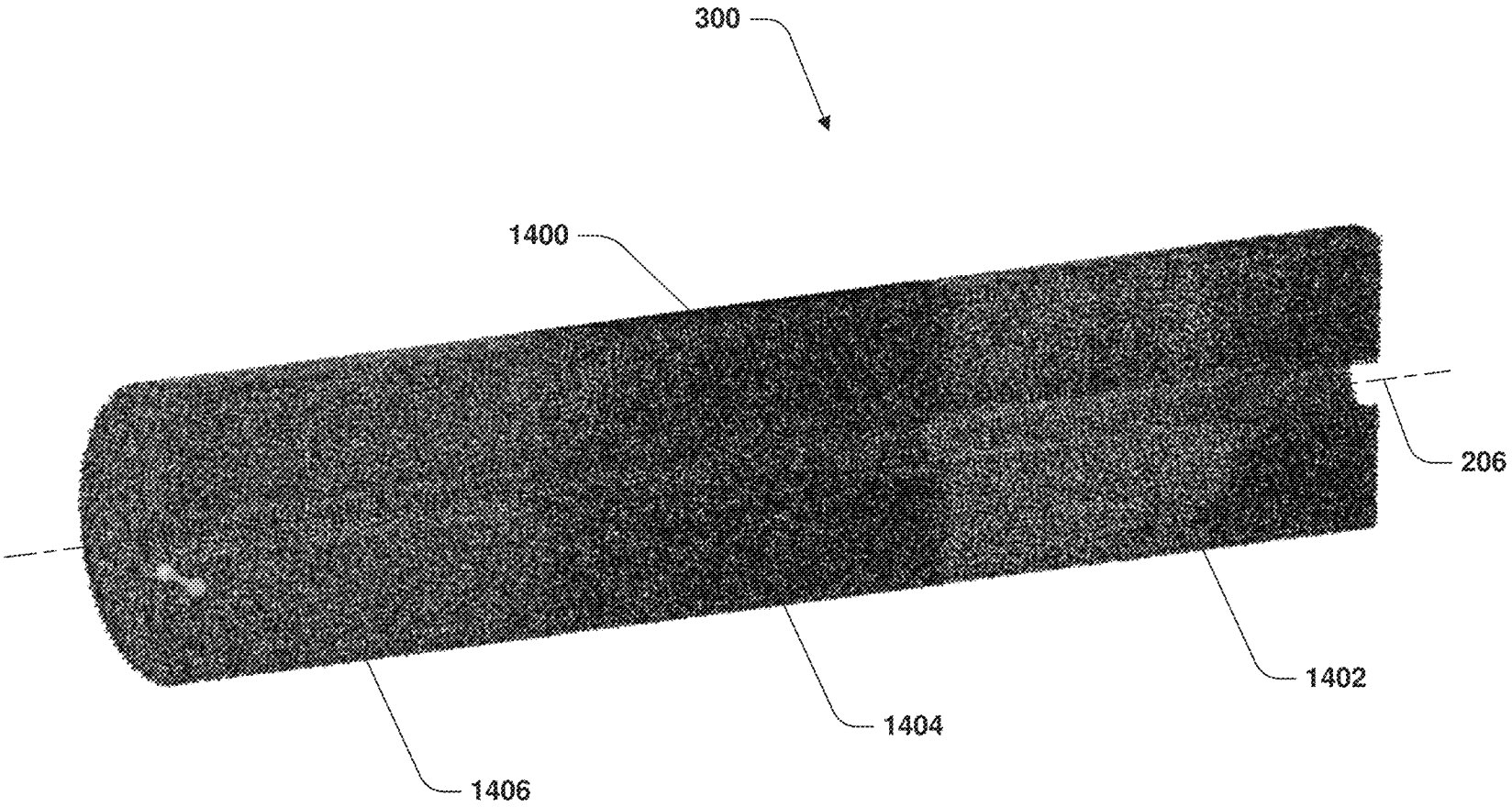
FIG. 15 is an axial cross-section of the core of FIG. 14 taken along line 15-15.

Referring to FIGS. 14-15, the second embodiment of the core 300 can be produced by an additive manufacturing process to develop a TOS having a mesh-like structure 1400 rather than the lattice-like structure of the previous TOS embodiment(s). The TOS having the mesh-like structure 1400 can include a relatively large number of nodes of solid material interconnected to multiple other nodes by shafts of solid material. This arrangement is shown in greater detail in FIGS. 16-19. The cap 1000, the material, and principles of the functions of the previous embodiments remain the same as the currently described embodiment shown in FIGS. 14-19.

In some examples, the core 300 can include a single open space volume percentage within the cylindrical volume defined by the core 300. For example, the mesh-like structure 1400 can have an open space percentage between about 55% and about 85% along the entire length of the core 300. FIG. 15 illustrates the core 300 in axial cross-section taken along a vertical plane.

In some examples, such as those shown in FIGS. 14-19, the core 300 can have continuously formed sections (e.g., monolithic construction) having different open space percentages along axial length of the core 300. For example, a section 1402, located at the barrel end 304 of the core 300 can have an open space percentage of about 85%. A middle section 1404 between the barrel end 304 and the muzzle end 306 can have an open space percentage of about 70%. A third section 1406 located at the muzzle end 306 can have an open space percentage of about 55%. Any number of suitable sections and various open space percentages can be utilized with the silencers 100 of the present disclosure. As such, the core 300, namely the TOS can have a variable density along the axial direction 318. In some examples, each of the sections 1402, 1404, and 1406 occupy one-third of the total length of the core 300.

Figure 16:
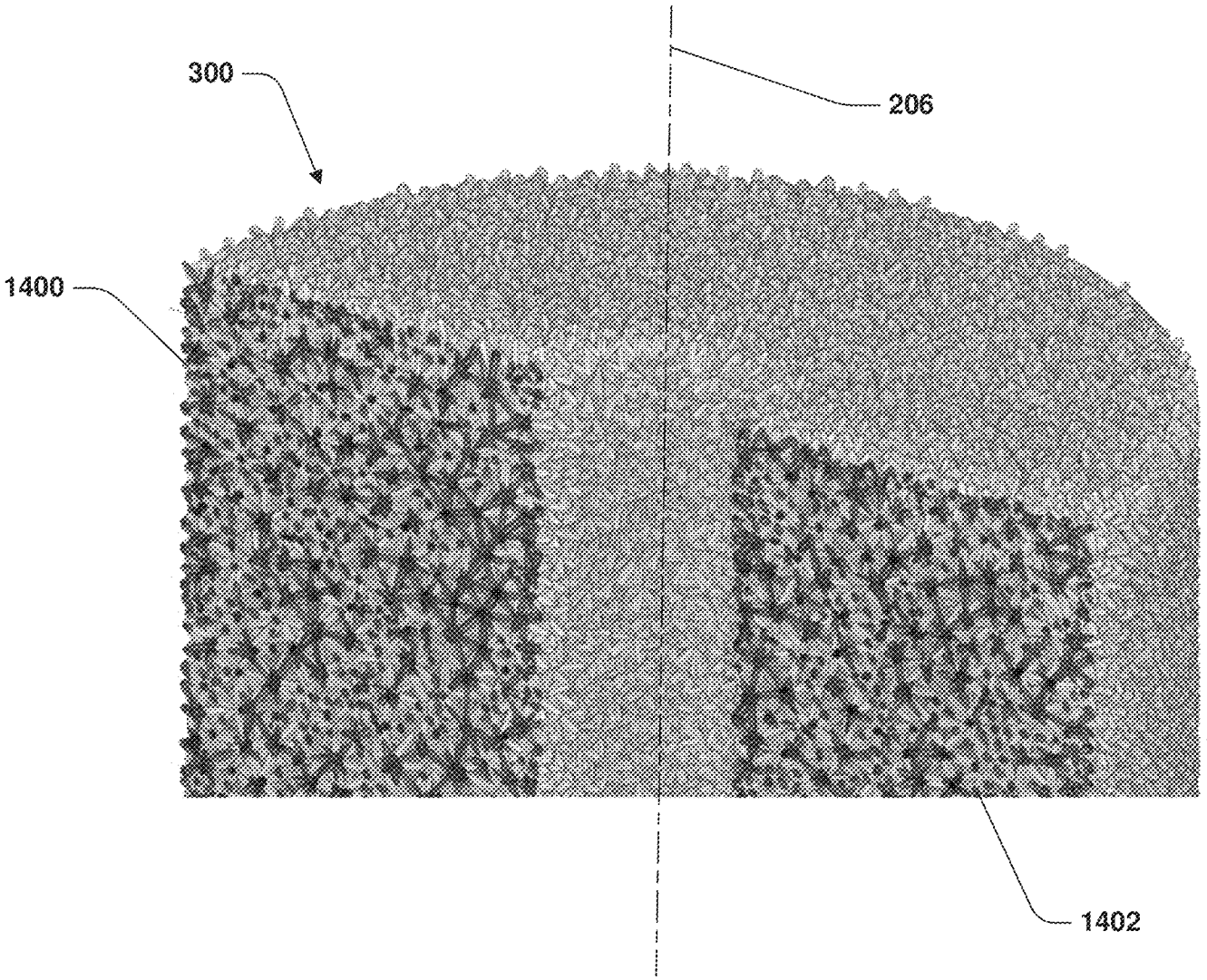
FIG. 16 is a detail view of the core of FIG. 14.

Referring to FIG. 16, a detail view of section 1402 is illustrated having the mesh-like structure 1400 constructed with an open space percentage of about 85% located at the barrel end 304 of the core 300. The mesh-like structure 1400 can be described as having a "strut," non-periodic cell formation produced by additive manufacturing.

Figure 17:
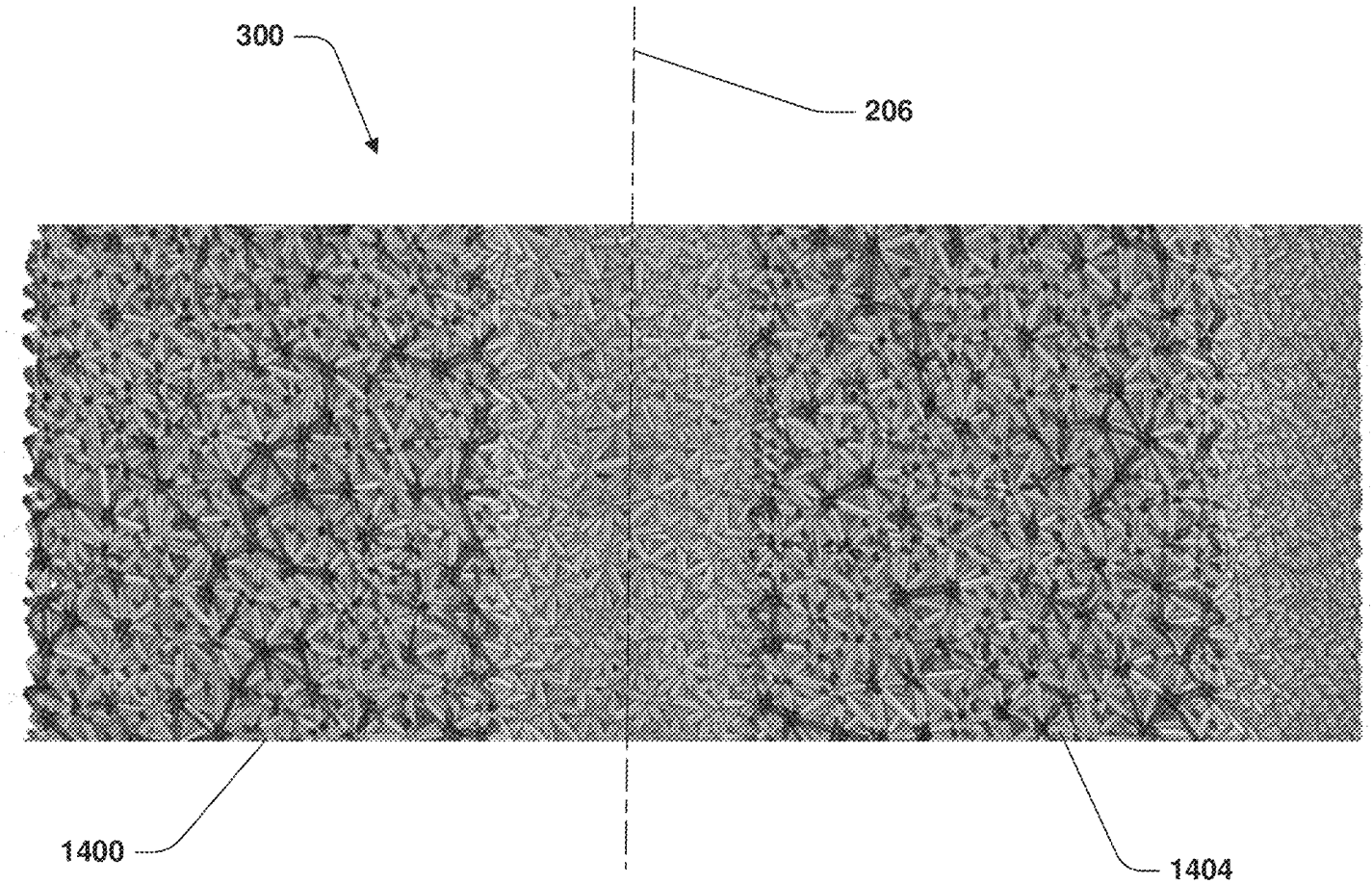
FIG. 17 is a detail view of the core of FIG. 14.

Referring to FIG. 17, a detail view of section 1404 is illustrated having the mesh-like structure 1400 constructed with an open space percentage of about 70% located between the barrel end 304 and the muzzle end 306 of the core 300. The mesh-like structure 1400 can be described as having a "strut," non-periodic cell formation produced by additive manufacturing similar to section 1402.

Figure 18:
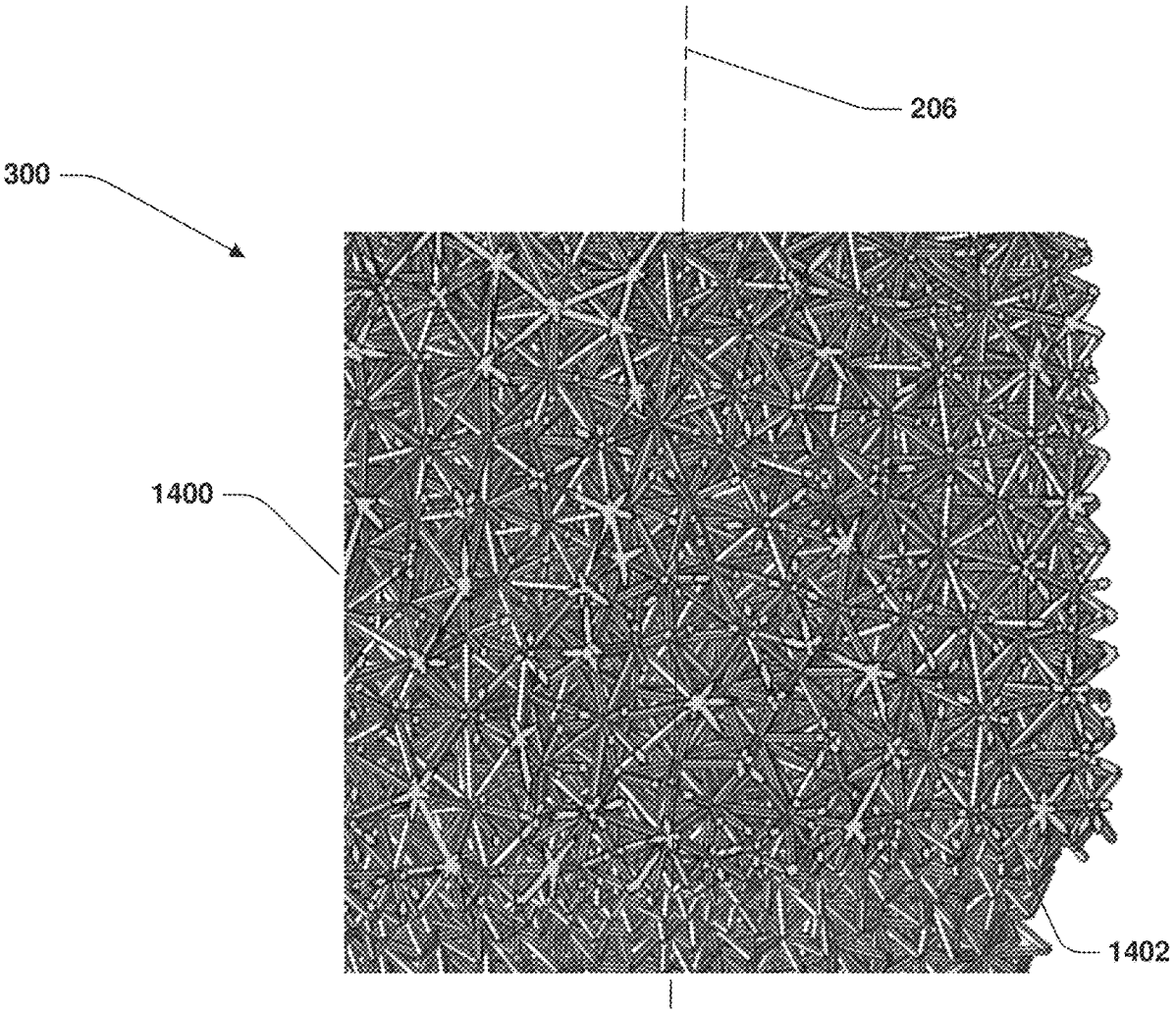
FIG. 18 is a detail view of the core of FIG. 14.
Figure 19:
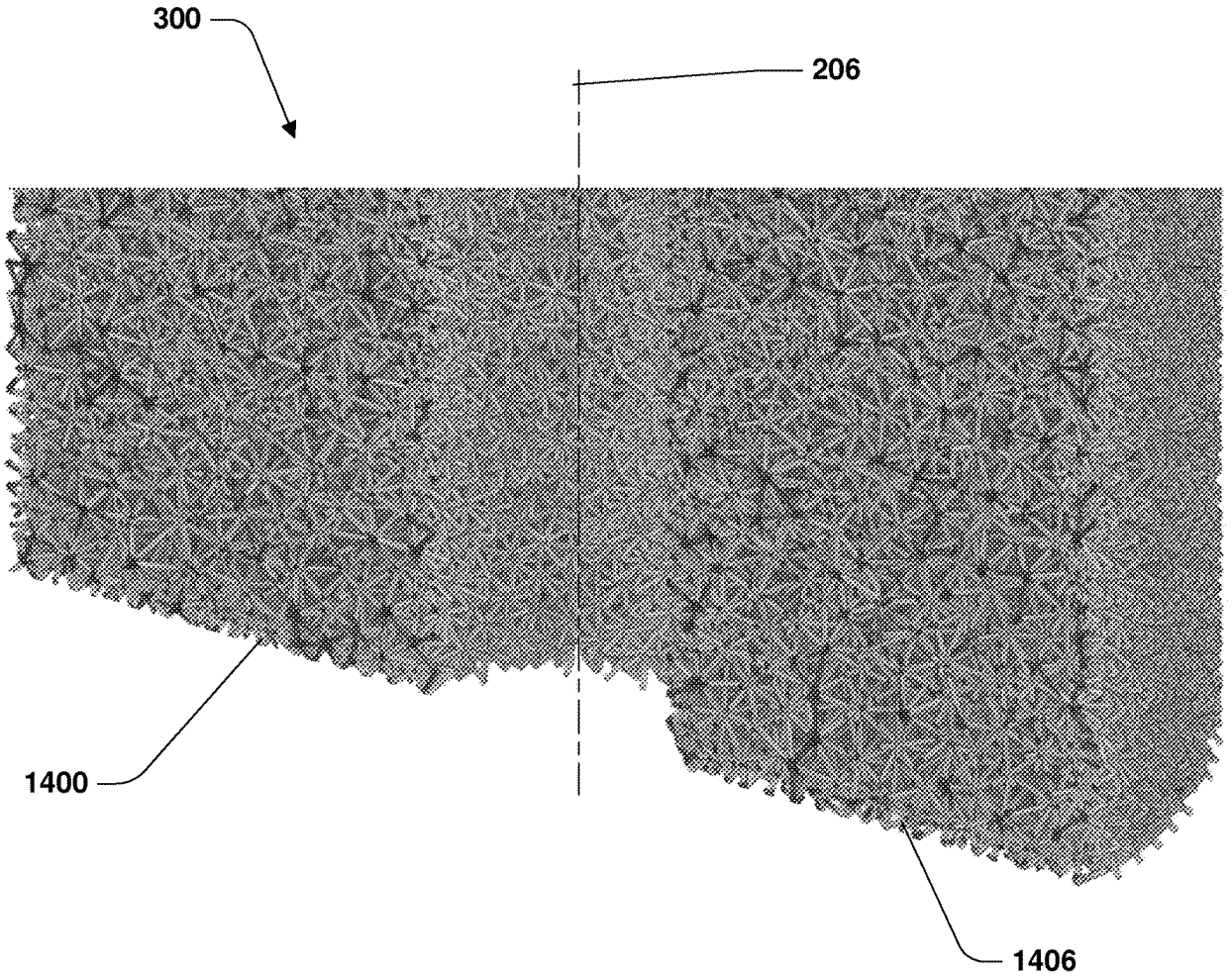
FIG. 19 is a detail view of the core of FIG. 14.

Referring to FIGS. 18 and 19, a detail view of section 1406 is illustrated having the mesh-like structure 1400 constructed with an open space percentage of about 55% located at the muzzle end 306 of the core 300. The mesh-like structure 1400 can be constructed similarly to sections 1402 and 1404.

Figure 20:
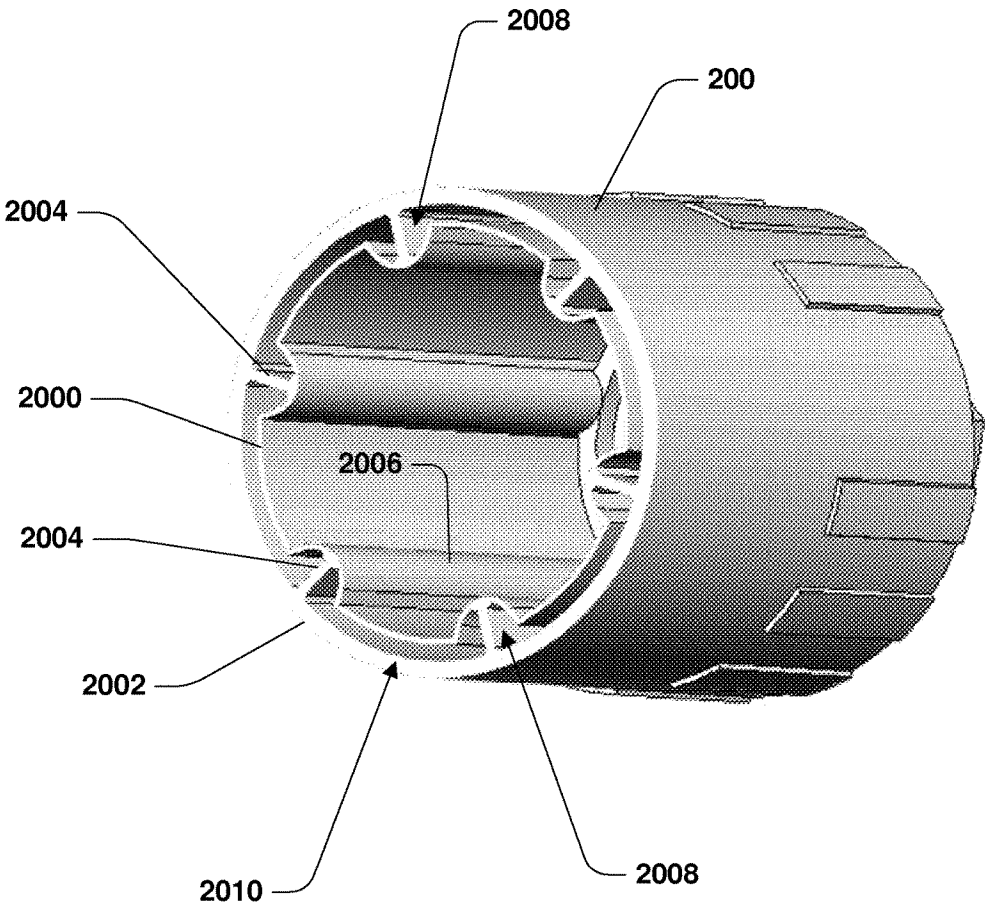
FIG. 20 is a radial cross-section view of the shell of FIG. 2.
Figure 21:
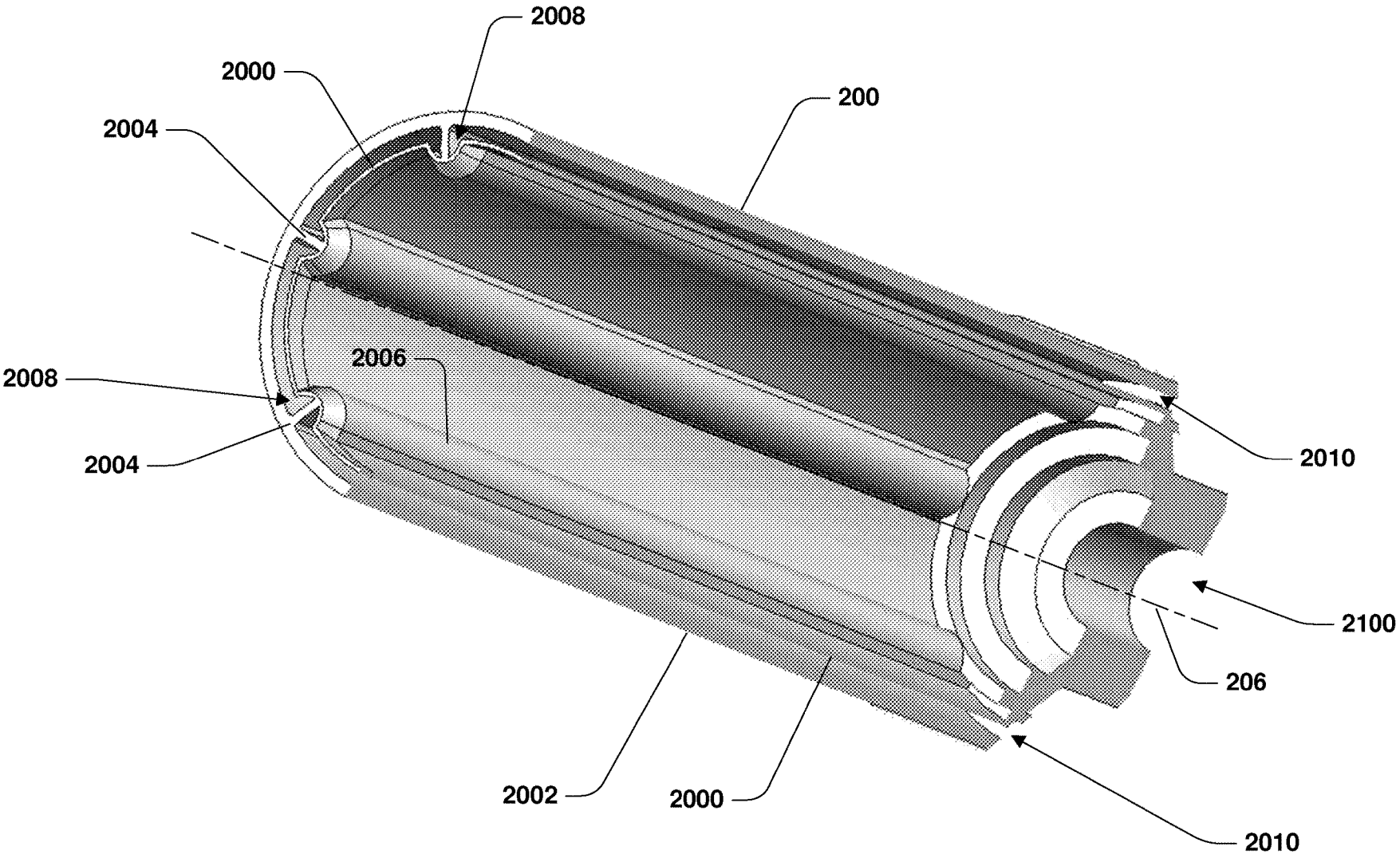
FIG. 21 is a partial axial cross-section view of the shell of FIG. 2.

Referring to FIGS. 20 and 21, the shell 200 can further include a first cylindrical member 2000 configured to interact with the mesh-like structure 1400. Any suitable method or structure of interaction is satisfactory. In some examples, the mesh-like structure 1400 physically contacts an inside diameter of the first cylindrical member 2000 to promote the conduction mode of heat transfer to dissipate heat. The mesh-like structure 1400 can also transfer heat to the first cylindrical member 2000 through radiation and convection heat transfer modes. The close interaction of the first cylindrical member and the core 300 can be seen in FIGS. 6-9.

The shell can also include a second cylindrical member 2002 spaced a distance from the first cylindrical member 2000. The second cylindrical member 2002 is concentric to the first cylindrical member 2000 and is attached to the first cylindrical member 2000 through a plurality of spokes 2004 extending from the first cylindrical member 2000 to the second cylindrical member 2002.

The shell 200 includes an axial baffle 2006 extending away from the first cylindrical member 2000 and toward the central axis 206, the axial baffle 2006 configured to provide an axial channel 2008 in fluid communication with a space outside the barrel end 202 and a space outside the muzzle end 204 of the shell 200. The axial baffle enables air flow to pass from the firearm end of the silencer 100 to the muzzle end 206 of the silencer 100. This airflow tends to dissipate the heat generated from firing the firearm 102 and tends to maintain a lower temperature on the exterior surface 108 of the silencer 100.

The first cylindrical member 2000 and the second cylindrical member 2002 together define an open space 2010 between the first cylindrical member 2002 and the second cylindrical member 2004. This open space 2006 enables air flow from the baffle 2006 to pass around the first cylindrical member to both dissipate heat and provide some level of thermal insulation between the first cylindrical member 2002 and the second cylindrical member 2004.

The shell 200 defines an entry aperture 2100 to permit entry of the ballistic projectile into the silencer 100. The entry aperture can be coaxial with the central axis 206 of the silencer 100.

Figure 22:
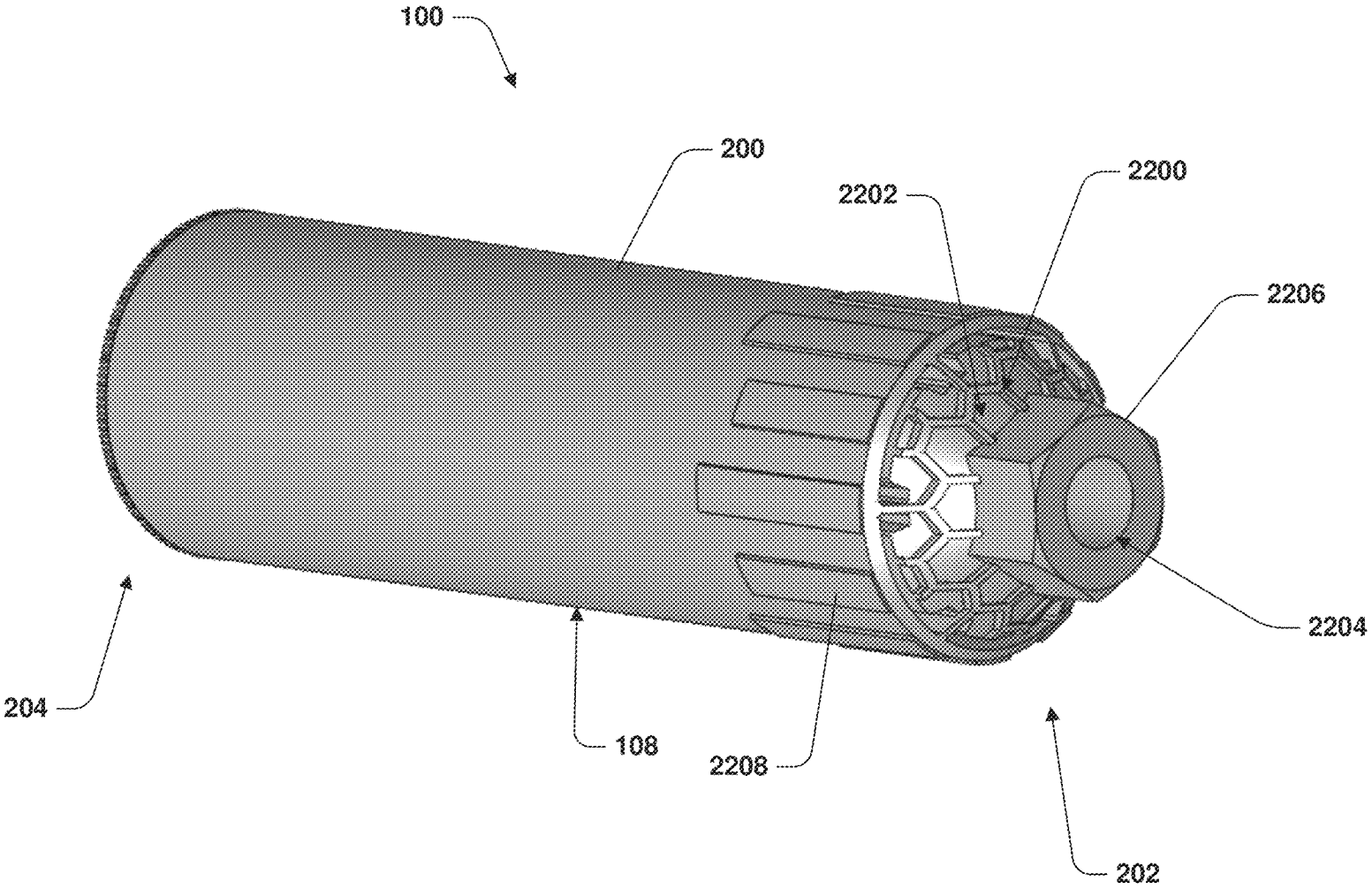
FIG. 22 is a perspective view of the shell of FIG. 2.

Referring to FIG. 22, the barrel end 202 of the shell 200 can include structures to promote radiation and convection heat modes to dissipate heat from the shell 200. In some examples, a raised hexagon pattern 2200 can be included on a rear surface 2202 of the shell 200. Alternatively or additionally, other patterns or no pattern can be included.

In some examples, the shell 200 includes a threaded member 2204 configured to cooperate with a threaded structure located on the barrel 106 (shown in FIG. 1) of the firearm 102. The shell 200 can also include wrench flats 2206 enabling use of a tool to selectively attach and detach the silencer 100 from the firearm 102. Alternatively or additionally, the shell 200 can also include raised patterns 2208 on the exterior surface 108.

In any of the embodiments discussed in the present disclosure, the silencer apparatus 100 can be engineered and manufactured to possess and utilize beneficial thermoacoustic properties. For example, each of the TOS 302 and the mesh-like structure 1400 can utilize particular materials in particular configurations of the TOS 302 and the mesh-like structure 1400 to convert a portion of the heat created by the firing of the ballistic projectile into sound waves. This energy conversion helps suppress and dissipate the heat produced during the firing of the firearm 102.

As shown in FIGS. 20 and 21, the main interior space of the shell 200 is closed at the barrel end 204, save for the entry aperture 2100 for the ballistic projectile to enter the silencer 100. Upon firing the firearm 102, relatively hot combustion gases at relatively high temperatures enter the shell 200. Because of this relatively rapid influx of combustion gases at relatively high temperature and pressure, the first cylindrical member 2000 can act as a tube closed at one end (e.g., the barrel end 202 of the shell 200), and open at the opposing end. The first cylindrical member 2000 responds as a thermoacoustic housing containing a pressurized compressible working fluid/gas (e.g., a mix of air and combustion gases). Supported inside the thermoacoustic housing, the TOS 302 or the mesh-like structure 1400 in the core 300 behave as a thermoacoustic-responsive material. That is, as an end of the core 300 is heated by the combustion gases, a temperature differential is created between the two ends of the core 300. This temperature gradient enables the thermoacoustic engine to generate one or more acoustic pressure waves via the working fluid/gas medium. Said another way, the pressurized working fluid/gas expands and contracts within the TOS 302 or the mesh-like structure 1400, moving heat from the hot end to the cold end. In so doing, the working fluid/gas can creates sound waves.

Thus, the thermoacoustic material properties of the core material(s) can absorb an amount of the heat introduced by the combustion gases. Additionally, the thermoacoustic effects of the engineered materials and the geometry and dimensions of the interconnected passages 312 can convert a quantity of the introduced heat into a plurality of sound waves inside the silencer 100. The plurality of waves can dissipate the heat and sound energy more evenly over time, to both reduce the heat transferred to the exterior surface 108 of the silencer 100 and the sound exiting the silencer 100.

In some examples, the interconnected passages 312 of the TOS 302 and/or the mesh-like structure 1400 provide many surfaces, edges, and passage turns that can help to scatter and absorb the sound waves. Additionally, the thermoacoustic materials can help move the quantity of heat relatively fast by using sound waves to "push" the heat. For example, cooler gas expands less violently, so less expansion within the silencer 100 leads to quieter sounds, helping to make the silencer 100 more efficient.

Although the apparatus and methods have been shown and described with respect to a certain embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the disclosure. In addition, while a particular feature of the disclosure may have been described above with respect to only one or more of several illustrated embodiments, such feature may be combined with one or more other features of the other embodiments, as may be desired and advantageous for any given or particular application.

What is claimed is:

1. A silencer core for suppressing and dissipating at least one of a sound, a flame, and a quantity of heat of a projectile fired from a firearm, the silencer core comprising:
a thermoacoustic organic structure (TOS) extending along a central axis from a first end to a second end, the TOS defines:
a central bore extending along the central axis from the first end to the second end, the central bore enabling the projectile to pass through the TOS when fired from the firearm, and
a network of interconnected passages configured to move at least one of combustion gases, heat, and sound from the central bore to an outside surface of the TOS, wherein a material forming the TOS has a density between 1.5 g/cm$^3$ and 4 g/cm$^3$.

2. The silencer core of claim 1, wherein the interconnected passages include an axial component and a radial component to move the at least one of combustion gases, heat, and sound in an axial direction and a radial direction perpendicular to the axial direction.

3. The silencer core of claim 1, wherein the material forming the TOS has a coefficient of thermal effusivity between 6,000 W·s$^{0.5}$/(m$^2$·K) and 100,000 W·s$^{0.5}$/(m$^2$·K).

4. The silencer core of claim 1, wherein the material forming the TOS is at least one of aluminum-magnesium-scandium alloy, TiAl4822, TiAl3, zirconium beryllide, Al68-Ti15-Zr12, silicon carbide, beryllium oxide, a ceramic compound, a metal matrix, and a ceramic matrix composite (CMC).

5. The silencer core of claim 1, wherein the TOS defines a cylindrical volume, the TOS defining an amount of open space within the cylindrical volume between 55% and 85% of a total volume defined by the cylindrical volume.

6. The silencer core of claim 1, wherein each radial interconnected passage of the network of interconnected passages is defined by a tortuous path from the central bore to the outside surface.

7. The silencer core of claim 1, wherein the silencer core is manufactured with an additive manufacturing process.

8. The silencer core of claim 1, wherein the material forming the TOS has physical properties to produce thermoacoustic effects to suppress and dissipate at least one of the sound and the quantity of heat.

9. A silencer apparatus for suppressing and dissipating at least one of a sound, a flame, and a quantity of heat of a projectile fired from a firearm, the silencer apparatus comprising:
a cylindrical thermoacoustic organic structure (TOS) extending along a central axis from a first end to a second end, the cylindrical TOS defines:
a central bore extending along the central axis from the first end to the second end, and
a network of passages configured to move at least one of combustion gases, heat, and sound from the central bore to an outside surface of the cylindrical TOS, wherein a material forming the cylindrical TOS has a density between 1.5 g/cm$^3$ and 4 g/cm$^3$; and
a shell extending from a barrel end to a muzzle end, the shell configured to at least partially surround and interact with the cylindrical TOS to facilitate heat transfer between the cylindrical TOS and the shell, the cylindrical TOS being selectively removable from the shell.

10. The silencer apparatus of claim 9, wherein the network of passages of the cylindrical TOS includes a network of curvilinear passages having components in an axial direction and a radial direction enabling movement of the at least one of combustion gases, heat, and sound from the central bore of the cylindrical TOS in the axial direction and the radial direction.

11. The silencer apparatus of claim 9, wherein the cylindrical TOS has a variable density along an axial direction.

12. The silencer apparatus of claim 9, wherein the shell further comprises:
a first cylindrical member configured to interact with the cylindrical TOS, and
a second cylindrical member spaced a distance from the first cylindrical member, the second cylindrical member concentric to the first cylindrical member and attached to the first cylindrical member through a plurality of spokes extending from the first cylindrical member to the second cylindrical member, wherein:
the first cylindrical member and the second cylindrical member together define an open space between the first cylindrical member and the second cylindrical member.

13. The silencer apparatus of claim 12, wherein the shell includes an axial baffle extending away from the first cylindrical member and toward the central axis, the axial baffle configured to provide an axial channel in fluid communication with a space outside the barrel end and a space outside the muzzle end of the shell.

14. The silencer apparatus of claim 13, wherein the axial channel is in fluid communication with a plurality of channels of the network of channels of the cylindrical TOS.

15. The silencer apparatus of claim 12, wherein the shell includes a heat exchange channel extending from the barrel end to the muzzle end, the heat exchange channel configured to provide fluid communication between a space outside the barrel end and a space outside the muzzle end of the shell to enable an amount of air flow through the heat exchange channel from the barrel end to the muzzle end.

16. The silencer apparatus of claim 9, wherein the shell includes a threaded member configured to cooperate with a threaded structure located on a barrel of the firearm.

17. The silencer apparatus of claim 9, further comprising a cap configured to be attached to the muzzle end of the shell.

18. A silencer apparatus for suppressing and dissipating at least one of a sound, a flame, and a quantity of heat of a projectile fired from a firearm, the silencer apparatus comprising:
a cylindrical thermoacoustic organic structure (TOS) extending along a central axis from a first end to a second end, the cylindrical TOS defines:
a central bore extending along the central axis from the first end to the second end; and
a network of passages configured to move combustion gases from the central bore to an outside surface of the cylindrical TOS, wherein:
a material forming the cylindrical TOS has a density between 1.5 g/cm$^3$ and 4 g/cm$^3$, and
the cylindrical TOS is formed by an additive manufacturing process; and
a shell extending from a barrel end to a muzzle end, the shell configured to at least partially surround and interact with the cylindrical TOS to facilitate heat transfer between the cylindrical TOS and the shell, wherein:
the cylindrical TOS and the shell behave as a thermoacoustic-responsive structure to suppress and dissipate at least one of the sound and the quantity of heat.

19. The silencer apparatus of claim 18, the shell comprising:

a first cylindrical member configured to interact with the cylindrical TOS; and a second cylindrical member spaced a distance from the first cylindrical member, the second cylindrical member concentric to the first cylindrical member and attached to the first cylindrical member through a plurality of spokes extending from the first cylindrical member to the second cylindrical member, wherein:

the first cylindrical member and the second cylindrical member together define an open space between the first cylindrical member and the second cylindrical member, and the cylindrical TOS is selectively removable from the shell.

20. The silencer apparatus of claim 18, wherein the cylindrical TOS defines a cylindrical volume, the cylindrical TOS defining an amount of open space within the cylindrical volume between 55% and 85% of a total volume defined by the cylindrical volume.

* * * * *